US011441264B1

(12) United States Patent
Hindi et al.

(10) Patent No.: US 11,441,264 B1
(45) Date of Patent: Sep. 13, 2022

(54) METHOD OF OBTAINING RAYON FIBERS

(71) Applicant: King Abdulaziz University, Jeddah (SA)

(72) Inventors: Sherif Hindi, Jeddah (SA); Uthman Mohammed Dawoud, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 0 days.

(21) Appl. No.: 17/670,474

(22) Filed: Feb. 13, 2022

(51) Int. Cl.

| | |
|---|---|
| ***D21C 5/02*** | (2006.01) |
| ***D01F 2/04*** | (2006.01) |
| ***D21C 9/08*** | (2006.01) |
| ***D21B 1/32*** | (2006.01) |
| ***D01F 2/08*** | (2006.01) |
| ***D21C 3/04*** | (2006.01) |

(52) U.S. Cl.
CPC ..... *D21C 5/022* (2013.01); *D01F 2/04* (2013.01); *D01F 2/08* (2013.01); *D21B 1/32* (2013.01); *D21C 3/04* (2013.01); *D21C 5/02* (2013.01); *D21C 9/08* (2013.01); *D10B 2201/24* (2013.01)

(58) Field of Classification Search
CPC ..... D21C 5/02; D21B 1/32; D01F 2/04
USPC ..... 162/157.7
See application file for complete search history.

(56) References Cited

U.S. PATENT DOCUMENTS

| | | | | |
|---|---|---|---|---|
| 617,009 A | | 1/1899 | Fremery et al. | |
| 658,632 A | | 9/1900 | Fremery et al. | |
| 850,695 A | | 4/1907 | Vermeesch | |
| 1,390,995 A | | 9/1921 | Kitsee | |
| 2,149,284 A | * | 3/1939 | Gordon | B27K 3/32 428/541 |

FOREIGN PATENT DOCUMENTS

| | | | | |
|---|---|---|---|---|
| GB | 444517 A | * | 5/1935 | D01F 2/04 |
| JP | 59163466 A | | 9/1984 | |
| JP | 4881218 B2 | | 12/2011 | |

OTHER PUBLICATIONS

Kauffman et al., A Demonstration of the Cuprammonium Rayon Progress, 1985,Journal of Chemical Education, p. 878. (Year: 1985).*

* cited by examiner

*Primary Examiner* — Anthony Calandra
(74) *Attorney, Agent, or Firm* — WCF IP

(57) ABSTRACT

A method of obtaining rayon fibers from cellulose waste is provided. The method includes extracting alpha-cellulose from cellulose waste, dissolving the alpha-cellulose in a cuoxam solution, obtained by reacting gaseous ammonia with an aqueous solution of copper hydroxide, to obtain a chemically modified cellulose. The chemically modified cellulose was extruded in an acid bath to obtain a precipitate. The precipitate was further neutralized to obtain the rayon fibers.

17 Claims, 20 Drawing Sheets

METHOD OF OBTAINING RAYON FIBERS

TECHNICAL FIELD

The present disclosure relates to a method of obtaining rayon fibers, and more specifically, the present disclosure relates to the method of obtaining rayon fibers using gaseous ammonia.

BACKGROUND

Renewable and sustainable resources are considered to be major forms of energy by industries due to their renewability, biodegradability, low environmental risks, and minimal health hazards. The most abundant macromolecule found in nature is cellulose. Cellulose and derivatives of cellulose are of great importance for various human activities. Native cellulose fibers are used extensively in textile, pulp and paper industries such as, textiles, films, fibers, granules, and composite materials. One such highly used fiber is rayon, which is a regenerated cellulose fiber, that is chemically similar to cotton but differs in physical properties. Rayon is crystalline and has a molecular weight that is one-fifth of cotton.

Rayon's versatility is the result of the fiber being chemically and structurally engineered by making use of the properties of cellulose from which it is made. Rayon fibers are used in the apparel industry such as aloha shirts, blouses, dresses, jackets, lingerie, scarves, suits, ties, hats, and socks. Besides the textile industry, rayon textile-reinforced composites are used in tires, conveyor belts, hoses, and v-belts. Viscose rayon, cuprammonium rayon, and saponified cellulose acetate are some of the types of rayon formed by various conventional methods.

Conventional methods for obtaining various types of rayon fibers such as viscose rayon, cuprammonium rayon, and saponified cellulose acetate involve reacting copper hydroxide with liquid ammonia under various reaction conditions. This process is less desirable because a high amount of liquid ammonia is required to react with copper hydroxide, thereby making the process very expensive. Also, the long reaction time makes the process time-intensive. Moreover, most of the conventional methods used to prepare the rayon fibers involve the use toxic chemicals such as carbon disulfide. Hence, there is a need for efficient, eco-friendly, and inexpensive techniques to prepare the rayon fibers.

SUMMARY

The present disclosure relates to a method of obtaining rayon fibers from cellulose waste. The method includes extracting alpha-cellulose from the cellulose waste. In one embodiment, the cellulose waste is recycled writing paper (RWP), cardboards and wood shavings. In one embodiment, the cellulose waste is RWP. In another embodiment, the method includes extracting alpha-cellulose from the cellulose waste by chemical maceration. In an embodiment, the chemical maceration involves treating the cellulose waste with 5% wt./wt. hydrogen peroxide and 5% wt./wt. citric acid. The macerated cellulose waste was further treated with mineral acid under reduced pressure. In an embodiment, the mineral acid is hydrochloric acid. The method further includes dissolving the alpha-cellulose in a cuoxam solution to obtain a chemically modified cellulose. The cuoxam solution is obtained by reacting gaseous ammonia with an aqueous solution of copper hydroxide. In an embodiment, the method includes reacting the gaseous ammonia with the aqueous solution of copper hydroxide at a temperature range of 5-15° C. under atmospheric pressure.

The aqueous solution of copper hydroxide may be prepared by reacting copper sulphate with sodium hydroxide at a temperature range of 25° C.-37° C. In one embodiment, a weight ratio (w/w) of copper sulphate to sodium hydroxide is in a range of 5:1 to 1:1. The method further includes extruding the chemically modified cellulose into an acid bath to obtain a precipitate, neutralizing the precipitate to obtain the rayon fibers. In an embodiment, the acid bath comprises citric acid. In another embodiment, a weight percentage of the citric acid in the acid bath is in a range of 8-15%. Furthermore, the method includes neutralizing the precipitate to obtain the rayon fibers.

In one embodiment, the rayon fibers have a staple length in a range of about 40 millimeters (mm) to about 50 mm, a linear density in a range of about 200 Tex to 250 Tex, and a fiber diameter in a range of 19 micrometers (μm) to about 20 μm. In another embodiment, the rayon fibers have a tensile strength in a range of about 218.3 Megapascals (Mpa) to about 236 Mpa, an elongation at break in a range of 14.3 Gigapascals (GPa) to about 15.6 GPa, and a modulus of elasticity in a range of 16.1 to about 36 Pa. In some embodiments, the rayon fibers have a breaking tenacity in a range of 27-58 cN/Tex. The rayon fibers are used to fabricate one or more of short fiber-staples, long fiber-staples, filament fibers, woven textiles, non-woven textiles, or any combination thereof.

The foregoing as well as other features and advantages of the present disclosure will be more fully understood from the following description, examples, and claims.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements. A skilled artisan will appreciate that various alternate embodiments and forms may be prepared. Examples, therefore, given are only for illustration purposes without any intention to restrict the embodiments to a given set of examples. Specific functional aspects are provided merely to enable a person skilled in the art to perform the invention and should not be construed as limitations of the invention. Any method steps and processes described herein are not to be construed as necessarily requiring their performance in the particular order discussed or illustrated, unless specifically identified as an order of performance. It is also to be understood that additional or alternative steps may be employed, unless otherwise indicated.

As used herein, "alpha-cellulose" refers to an un-degraded high-molecular weight cellulose content in the pulp.

As used herein, "cuoxam solution" refers to the solution of cupric hydroxide in ammonia.

The term "extruding" refers herein to a process to thrust out, force out, push out or press out an object to form the desired shape.

As used herein, "extracting" refers to is a process in which one or more components are separated selectively from a liquid or solid mixture.

The use of the singular herein includes the plural (and vice versa) unless specifically stated otherwise.

The use of the terms "include," "includes", "including," "have," "has," or "having," "comprise," "comprises," "comprising" or the like should be generally understood as open-ended and non-limiting unless specifically stated otherwise.

It is understood that the order of steps or order for performing certain actions can be changed so long as the intended result is obtained. Moreover, two or more steps or actions may be conducted simultaneously.

As used herein, the term "about" or "between" refers to a ±20% to ±10% variation from the nominal value unless otherwise indicated.

Figure 1:
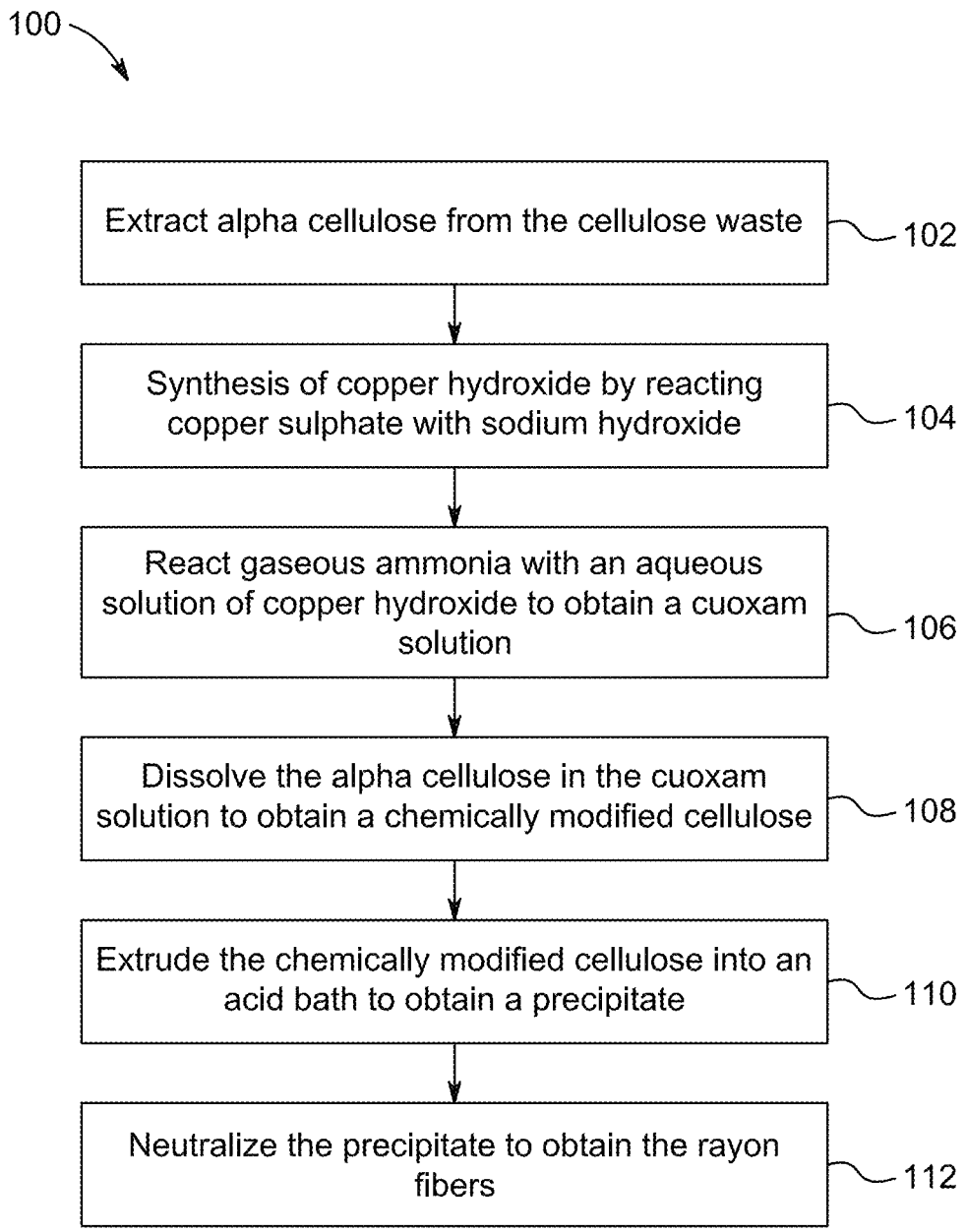
FIG. 1 is an exemplary flowchart illustrating a method for preparing the rayon fibers.

Referring to FIG. 1, a method 100 of obtaining rayon fibers from a cellulose waste is described. Rayon fiber is used in the textile industry for making clothing such as, but not limited to, shirts, pants, dresses, under garments, etc. It is also used in furnishing materials such as, but limited to, bed sheets, curtains, blankets, mattresses, carpets, etc. In the medical field, rayon fibers are used for surgical dressing materials. At step 102, the method 100 includes extracting alpha-cellulose from the cellulose waste. The cellulose waste includes materials such as, but not limited to, waste wood pulp, waste textile cellulose, or RWP, cardboards and wood shavings. In one embodiment, the cellulose waste is RWP. Although the description herein suggests the use of RWP as the cellulose waste, it may be understood by a person skilled in the art that methods of the present disclosure can be adapted to other forms of cellulose waste as well. The extraction of alpha-cellulose from the cellulose waste may be done by methods known in the art, such as micro-extraction, liquid extraction, maceration, or combinations thereof. In one embodiment, the method 100 includes extracting alpha-cellulose from the cellulose waste by chemical maceration. The chemical maceration process involves soaking the cellulose waste in a solution, for softening. In some embodiments, the solution is hydrogen peroxide, an acid such as citric acid, or a combination thereof. In some embodiments, the macerated cellulose was treated with hydrogen peroxide (5% wt./wt.) and citric acid (5% wt./wt.). This step eases the separation of alpha-cellulose and any unwanted materials, such as calcium carbonate from the cellulose waste. In an embodiment, the method 100 includes treating the macerated cellulose waste with a mineral acid under reduced pressure. In one embodiment, the mineral acid is hydrochloric acid.

At step 104, the aqueous solution of copper hydroxide was obtained by reacting copper sulphate with sodium hydroxide. In an embodiment, the copper sulphate and sodium hydroxide may be reacted at a temperature range of 22° C. to about 40° C. In another embodiment, the copper sulphate and sodium hydroxide may be reacted at a temperature range of 25° C. to about 37° C. In yet another embodiment, the copper sulphate and sodium hydroxide may be reacted at a temperature range of about 28° C. to about 32° C. In some embodiments, a weight ratio (w/w) of copper sulphate to sodium hydroxide is in a range of about 5:1 to about 1:1.

At step 106, the method 100 includes reacting gaseous ammonia with the aqueous solution of copper hydroxide to obtain a cuoxam solution. The cuoxam solution (also known as tetra-ammine cupric hydroxide) is an aqueous solution of copper hydroxide and ammonia, and has the ability to dissolve the cellulose to successfully form rayon fibers. In an embodiment, the method 100 includes reacting gaseous ammonia with the aqueous solution of copper hydroxide at a temperature range of 3° C. to about 18° C. under atmospheric pressure. In another embodiment, the method 100 includes reacting gaseous ammonia with the aqueous solution of copper hydroxide at a temperature range of 5° C. to about 15° C. under atmospheric pressure. In yet another embodiment, the method 100 includes reacting gaseous ammonia with the aqueous solution of copper hydroxide at a temperature range of 8° C. to about 12° C. under atmospheric pressure.

At step 108, the method 100 includes dissolving the alpha-cellulose in the cuoxam solution to obtain a chemically modified cellulose. The chemically modified cellulose may be treated in various ways to obtain different end products. At step 110, the method 100 includes extruding the chemically modified cellulose into an acid bath or a hardening bath to obtain a precipitate. The acid bath may include acid such as, but not limited to, acetic acid, citric acid, etc. In an embodiment, the acid bath includes citric acid. In an embodiment, a weight percentage of the citric acid in the acid bath is in a range of 6% to about 17%. In another embodiment, a weight percentage of the citric acid in the acid bath is in a range of 8% to about 15%. In yet another embodiment, a weight percentage of the citric acid in the acid bath is in a range of 10% to about 13%. At step 112, the method 100 includes neutralizing the precipitate to obtain the rayon fibers. In an embodiment, the precipitate is neutralized with sodium carbonate, sodium bicarbonate, buffer solutions, other aqueous solutions that may assist in neutralizing the mixture to a pH of about 7. The precipitate may further be processed by spinning techniques to obtain thread-like structures. In some embodiments, the spinning techniques may be wet spinning, dry spinning, melt spinning, gel spinning, etc.

The rayon fiber obtained by the process of the present disclosure offers better qualities compared to the conventional process. In an embodiment, the rayon fibers have a staple length in a range of 35 millimeters (mm) to about 55 mm. In another embodiment, the rayon fibers have a staple length in a range of 40 mm to about 50 mm. In yet another embodiment, the rayon fibers have a staple length of about 45 mm. In one embodiment, the rayon fibers have a linear density in a range of 185 Tex to about 265 Tex. In another embodiment, the rayon fibers have a linear density in a range of 200 Tex to about 250 Tex. In yet another embodiment, the rayon fibers have a linear density in a range of 215 Tex to about 235 Tex. The Tex system is defined as the mass in grams per 1,000 meters. In an embodiment, the rayon fibers have a fiber diameter in a range of about 19 micrometers (μm) to about 20 μm.

The rayon fibers have a tensile strength in a range of 218.3 Mpa to about X Mpa. In one embodiment, the rayon fibers have an elongation at break in a range oft 16.1% to 36%. In another embodiment, the rayon fibers have a modulus of elasticity in a range of 14.3 to 15.6 Gigapascals (GPa). In yet another embodiment, the rayon fibers have a breaking tenacity in a range of 27 cN/Tex to about 58 cN/Tex. The rayon fibers may be selected from short fiber-staples, long fiber-staples, filament fibers, woven textiles, non-woven textiles, or any combination thereof. The rayon fibers prepared by the process of the present disclosure allows the use of gaseous ammonia effectively, obviating the drawbacks associated with time and costs. Further, the rayon fibers obtained from the process of the present disclosure shows good physical properties and chemical properties.

EXAMPLES

The disclosure will now be illustrated with examples, which are intended to illustrate the working of disclosure and not intended to take restrictively to imply any limitations on the scope of the present disclosure.

Example 1: Process for the Preparation of Rayon Fibers

Materials and Methods

The fundamental procedure performed to produce the rayon fibers from the RWP is mentioned below. The practical scheme is restricted to the following steps, namely: a) isolating or extracting the cellulosic fibers (alpha-cellulose) from the RWP by chemical maceration process. The chemical maceration process eliminates gum, ink, calcium carbonate from the cellulose waste. b) preparing an aqueous solution of $Cu(OH)_2$; c) gaseous ammoniation process of the aqueous solution of $Cu(OH)_2$ to synthesize the cuoxam solution, d) dissolving the cellulose fibers (alpha-cellulose) into the cuoxam solution, e) preparing the curing solution or hardening bath of citric acid (10%, wt/wt), f) regenerating the cellulose waste to the rayon fibers by extruding the rayon fibers in the hardening bath, and g) washing and neutralizing the extruded rayon fibers.

Raw Materials

Figure 2B:
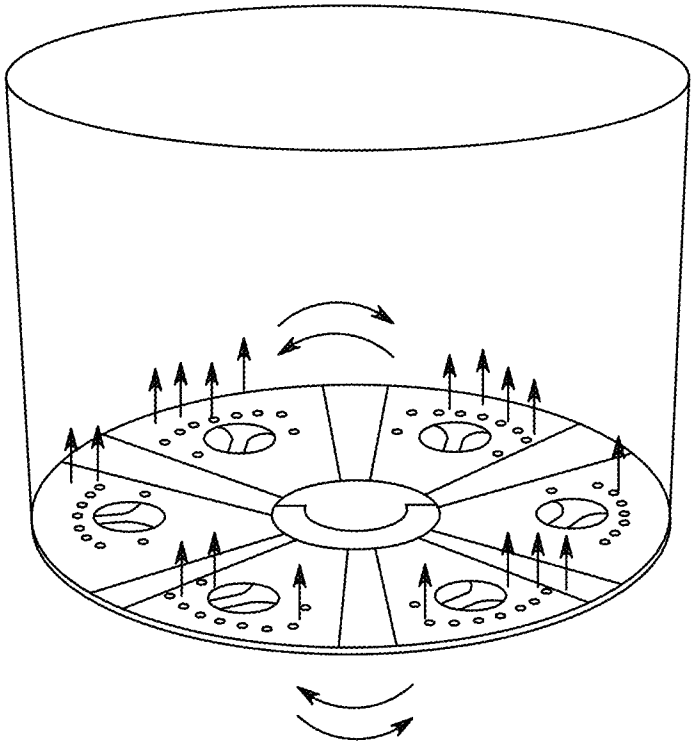
FIG. 2B is a reversible rotative jet stream utensil.
Figure 2A:
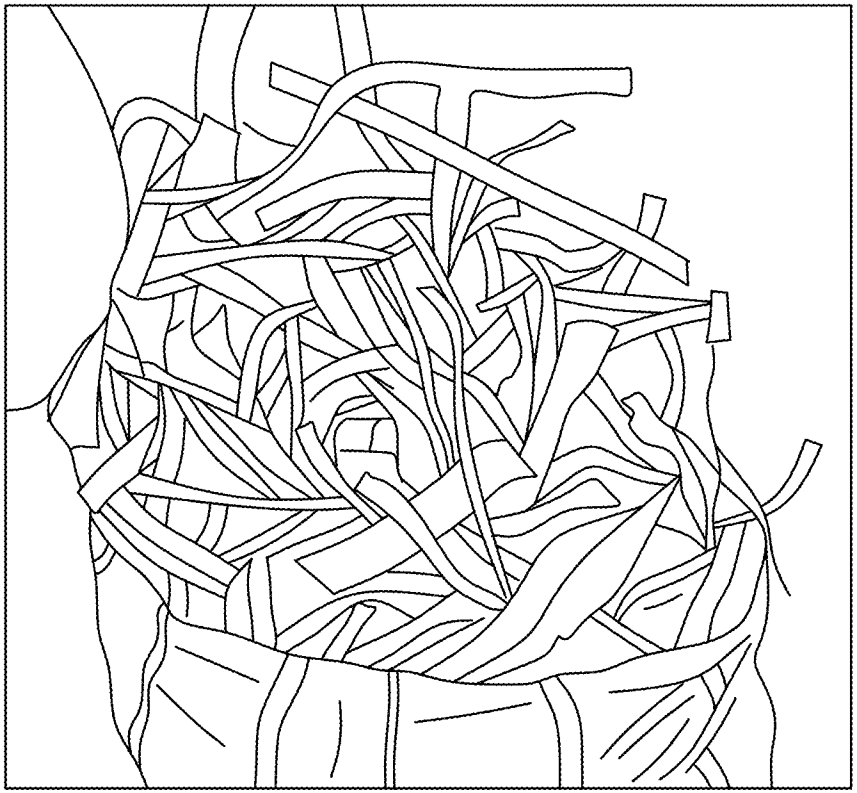
FIG. 2A shows a sample of recycled waste paper (RWP) used as a cellulose precursor for synthesis of the rayon fibers.

FIG. 2A shows a sample of RWP used as a cellulose precursor for synthesis of the rayon fibers. The RWP was collected from the King Abdullaziz University Press, Jeddah, Saudi Arabia. For this purpose, snippets of RWP was made using mechanical scissors. The RWP is manufactured using wood-based cellulosic fibers known anatomically as prosenchyma cells found extensively in trees as well as perennial plants. The cellulose was isolated from the RWP's snippets by using a reversible rotative water jet stream (as shown in FIG. 2B). The shear forces arising due to the water effects are responsible for the separation of the previously-dignified prosenchyma cells.

Example 2: Chemical Elimination of Calcium Carbonate from the RWP

Figure 3:
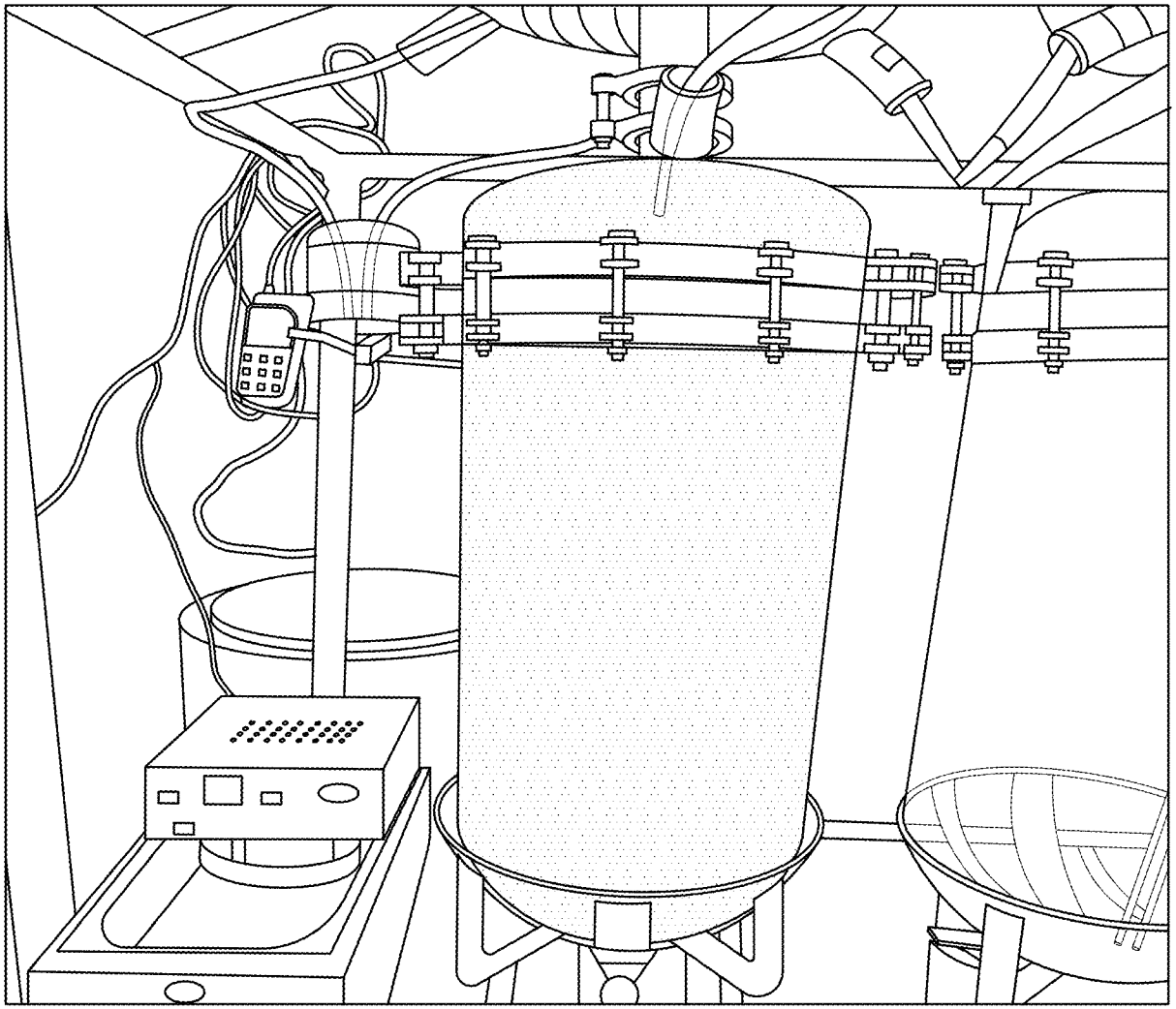
FIG. 3 a chemical process set up for the elimination of calcium carbonate from the RWP using diluted hydrochloric acid (HCl)
Figure 4C:
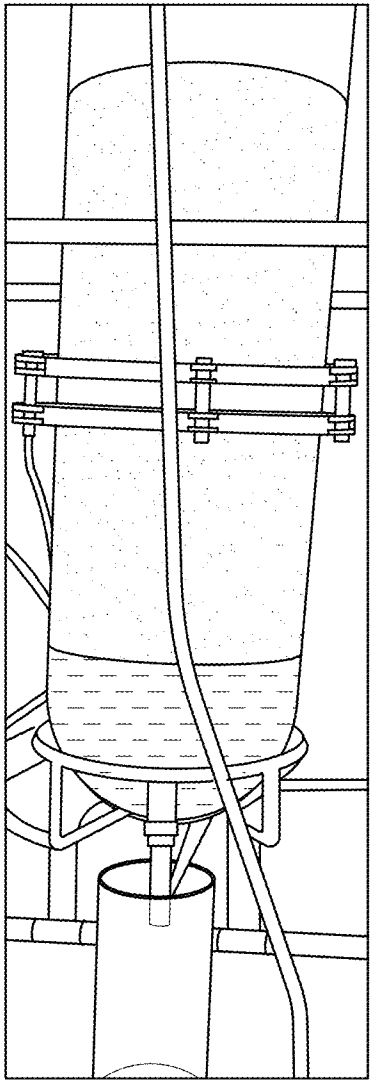
FIG. 4C shows a solution forming copper hydroxide ($Cu(OH)_2$) for the prototype-scaled synthesis of copper hydroxide.
Figure 4B:
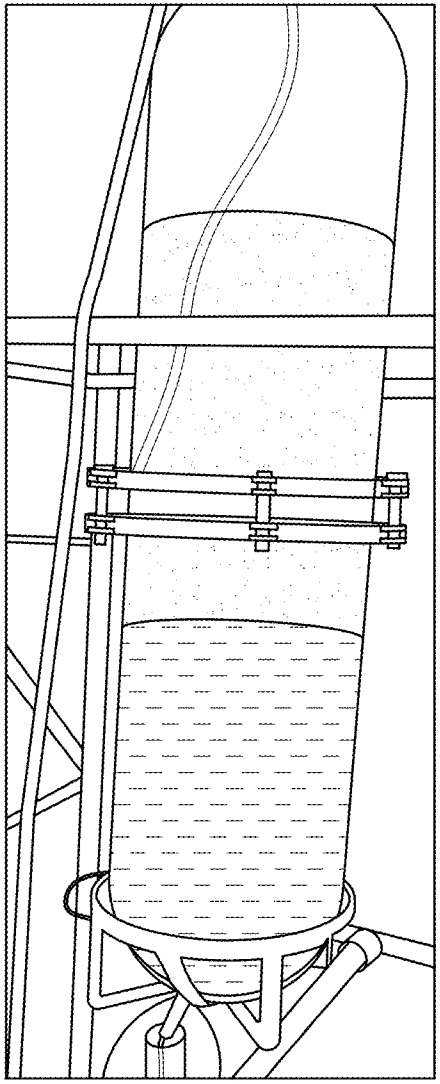
FIG. 4B shows a mixture of sodium hydroxide (NaOH) in copper sulphate for the prototype-scaled synthesis of copper hydroxide.
Figure 4A:
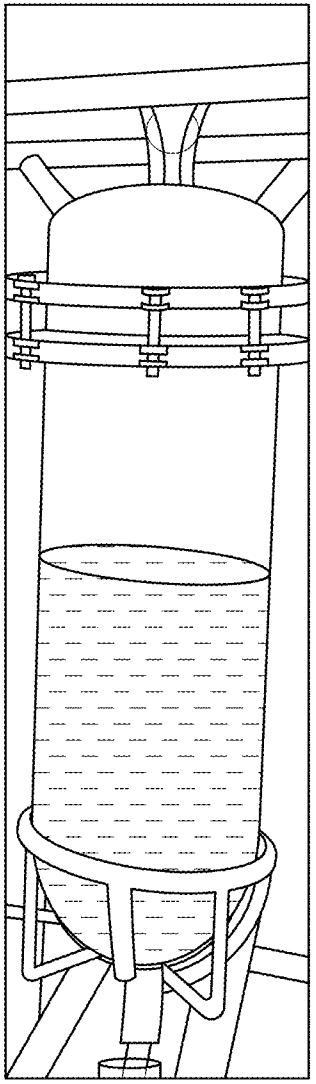
FIG. 4A shows a solution of copper sulphate ($CuSO_4$) for the prototype-scaled synthesis of copper hydroxide.
Figure 4E:
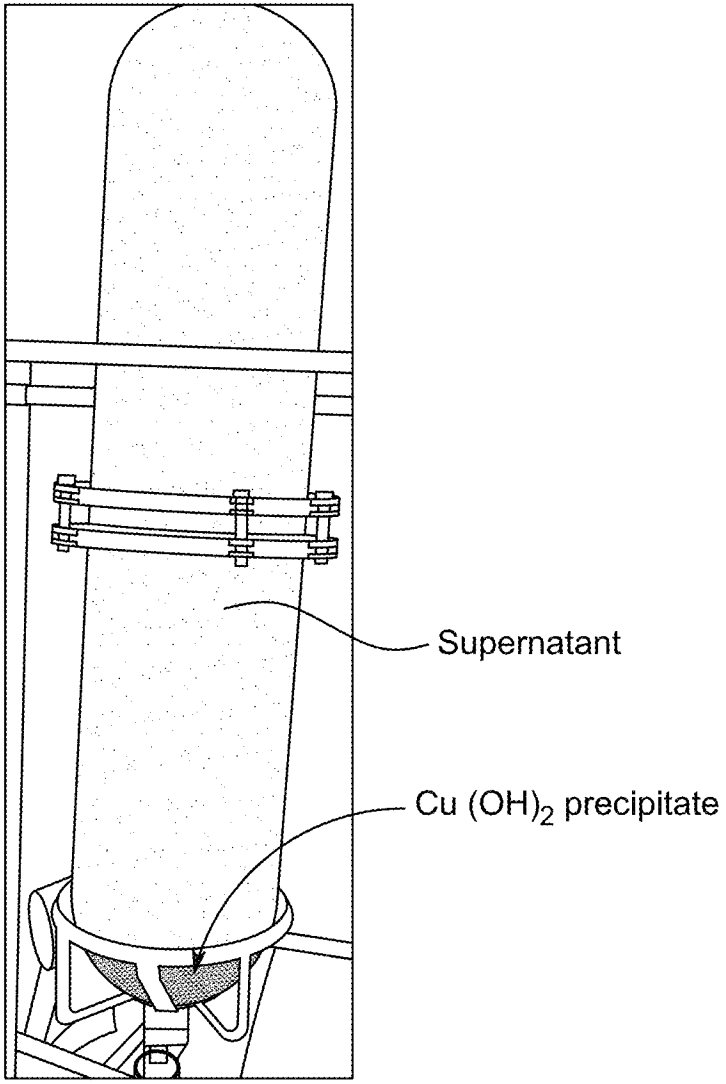
FIG. 4E shows a precipitate of copper hydroxide beneath a supernatant.
Figure 4D:
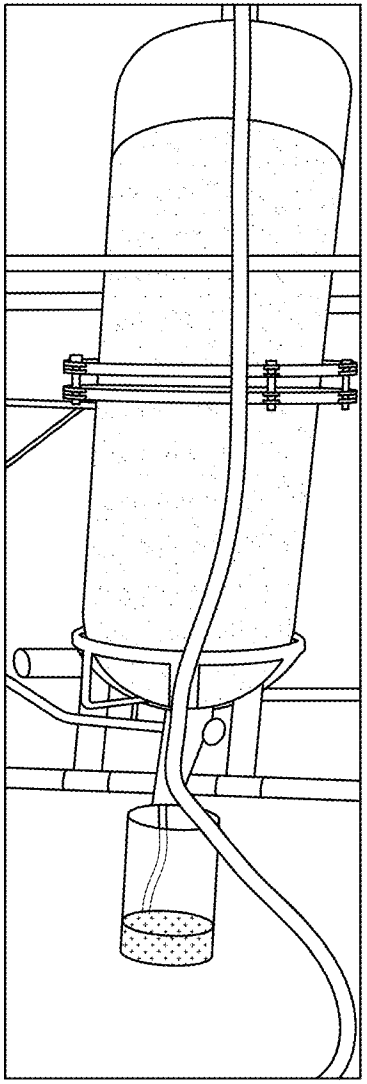
FIG. 4D shows a completed formation of copper hydroxide for the prototype-scaled synthesis of copper hydroxide.

FIG. 3 shows a chemical process set up for the elimination of calcium carbonate from the RWP using diluted hydrochloric acid (HCl). Calcium carbonate ($CaCO_3$) was chemically discarded from the RWP by using HCl acid (0.2%, wt/wt under reduced pressure). The Pyrex tank was used to treat the macerated cellulosic pulp resulting from the RWP as shown in FIG. 3. Monitoring the progress of the chemical maceration process was performed using optical microscopy. An optical speculation unit consists of a light microscope (CE-MC200A) in a magnification power of 10× with a suitable vision system (OPTIKA PRO 5 Digital Camera—4083.12, OPTIKA, Italy) with a Vision PRO 4 software was used to pick up, processing images, record different measurements. One drop of cellulosic supernatant was mounted, and spread onto a glass slide without staining. The cellulose supernatant was speculated under a microscope at a suitable magnification. Chemical Reagents (CR)

Seven chemical reagents were used for the synthesis of the rayon fibers (Table 1). Four of them, namely copper sulphate, sodium hydroxide, ammonia gas, and citric acid were purchased in a commercial grade. The reminder CR, namely copper hydroxide and cuoxam solution were prepared in the laboratory.

Table 1. shows Chemical reagents (CR) and their formulas, concentrations, and reagent role in the production of cuprammonium rayon.

TABLE 1

| CR | Formula | Concentration % (wt/wt) | The reagent role |
|---|---|---|---|
| Hydrochloric acid | HCl | 0.2 | Dissolving calcium carbonate ($CaCO_3$) found in the RWP. |
| Copper sulphate | $CuSO_4$ | 5 | |
| Sodium hydroxide | NaOH | 1 | Produce copper hydroxide [Cu $(OH)_2$]. |
| Copper hydroxide | [Cu $(OH)_2$] | 80 | Is ammoniated to produce the cuoxam solution |
| Ammonia gas | $NH_3$ (gas) | 100 | Grafting four [$NH_3^-$] groups on copper hydroxide to produce the cuoxam solution. |
| Cuoxam solution | [{$Cu(NH_3)_4$}$(OH)_2$] | 100 | Dissolving cellulose |
| Citric acid | $C_6H_8O_7$ | 10 | Hardening the rayon fibers in the curing bath or the hardening bath. |

Copper Sulphate [$CuSO_4$] Solution (5%)

Copper sulfate pentahydrate is the hydrate and a metal sulfate of copper (+2). It appears as blue crystalline granules with a melting point of 110° C., non-combustible nature, nauseating metallic taste, odorless smell, and white aspect when is dehydrated (Anonymous, 2021). About 50 g of $CuSO_4$ was dissolved in one liter of deionized water to get a 5% concentration. After the complete dissolution, the supernatant was filtered using polypropylene textile having about 10-20 μm and stored until used.

Sodium Hydroxide (NaOH) Solution (1%)

Sodium hydroxide is also known as lye or soda, or caustic soda. At room temperature, It is a white crystalline odorless solid that absorbs moisture from the air. When dissolved in water or neutralized with acid, it releases substantial amounts of heat. NaOH is used to manufacture soaps, rayon, paper, explosives, dyestuffs, and petroleum products. It is also used in processing cotton fabric, laundering and bleaching, metal cleaning and processing, oxide coating, electroplating, and electrolytic extracting. In addition, it is considered the best alkaline pH controller agent (Anonymous, 2021). About 10 g of the NaOH was well-dissolved in one liter of deionized water to get a 5% concentration.

Synthesis of Copper Hydroxide [$Cu(OH)_2$]

$Cu(OH)_2$ was prepared in this study in two different scales, namely laboratory-scaled and prototype-scaled syntheses. It was formed due to the reaction between copper sulphate and caustic soda at room temperature with continuous stirring (Rana et al., 2014). 5% wt/wt of citric acid was added to the $CuSO_4$ solution to prevent its hydrolysis. FIG. 4A, FIG. 4B, FIG. 4C, FIG. 4D, and FIG. 4E shows prototype-scaled syntheses of $Cu(OH)_2$ showing step-wise changes in the process. From the FIG. 4A to FIG. 4E, it can be seen that the solution of copper sulphate changes to by the addition of sodium hydroxide in the same volumetric ratio (1:1).

$$CuSO_4+NaOH \rightarrow Cu(OH)_2+NaSO_4$$

Ammonia Gas for Ammoniation Process

Four ammonia groups via adding the ammonia gas was directly purged to the solution of $Cu(OH)_2$ to obtain the cuoxam solution.

$$4NH_4OH+Cu(OH)_2 \rightarrow Cu(NH_3)_4(OH)_2+4H_2O$$

Figure 5A:
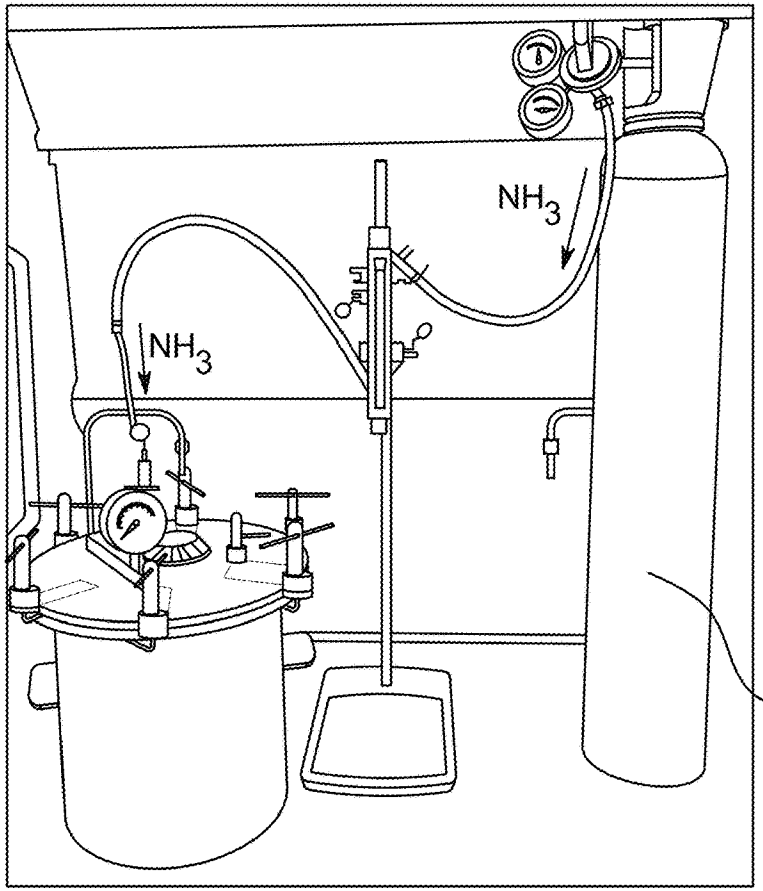
FIG. 5A shows a novel gaseous ammoniation system used to inject ammonia gas into copper hydroxide for synthesis of cuoxam solution by pressurized injection of the ammonia gas in a special vessel.
Figure 5B:
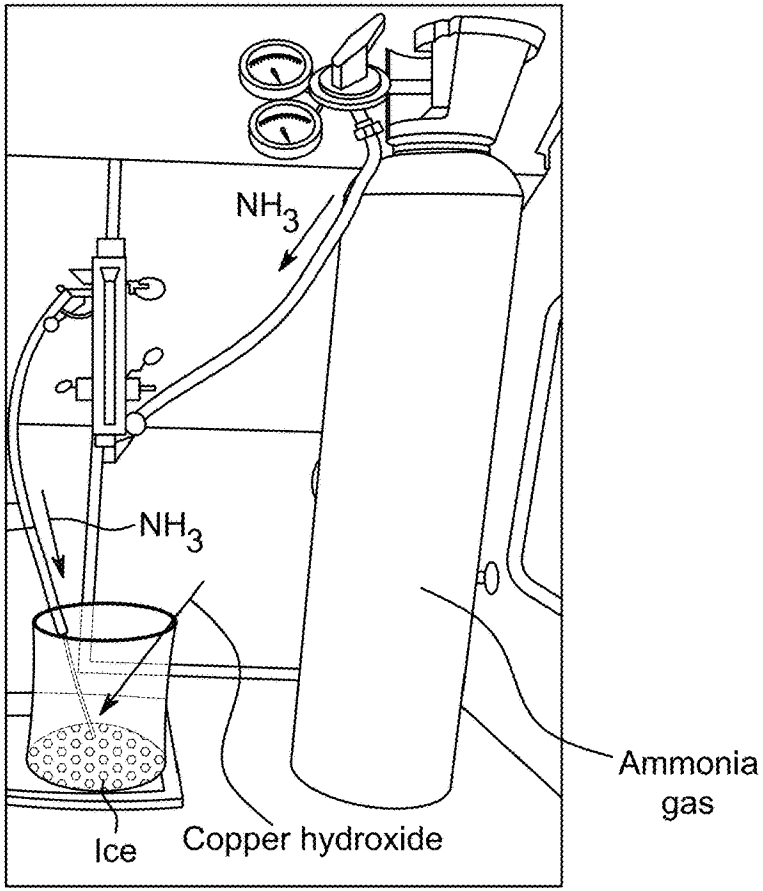
FIG. 5B shows a novel gaseous ammoniation system used to inject ammonia gas into copper hydroxide for the synthesis of cuoxam solution by treating the gaseous ammonia under the normal atmospheric pressure.

In an embodiment, the ammonia gas can be pressurized into the $Cu(OH)_2$ paste within a pressure vessel to accelerate the rate of ammoniation process, as well as saving the gas lost or in an open system like a beaker. FIG. 5A shows a gaseous ammoniation system used to inject ammonia gas into copper hydroxide for the synthesis of cuoxam solution by pressurized injection of the ammonia gas in a special vessel. FIG. 5B shows a novel gaseous ammoniation system used to inject ammonia gas into copper hydroxide for the synthesis of cuoxam solution by treating the gaseous ammonia under the normal atmospheric pressure. This gas was purchased from Abdullah Hashim Industrial Gases & Equipment Co. Ltd, Jeddah. It is an inorganic compound composed of a single nitrogen atom covalently bonded to three hydrogen atoms. It is described by its colorless with a very distinct odor (Anonymous 2021), so this reaction must be performed is in good ventilation conditions and/or in a fume hood to limit exposure to the gas.

Cuoxam Solution: Preparation by Direct Gaseous Ammoniation of Copper Hydroxide

Figure 6:
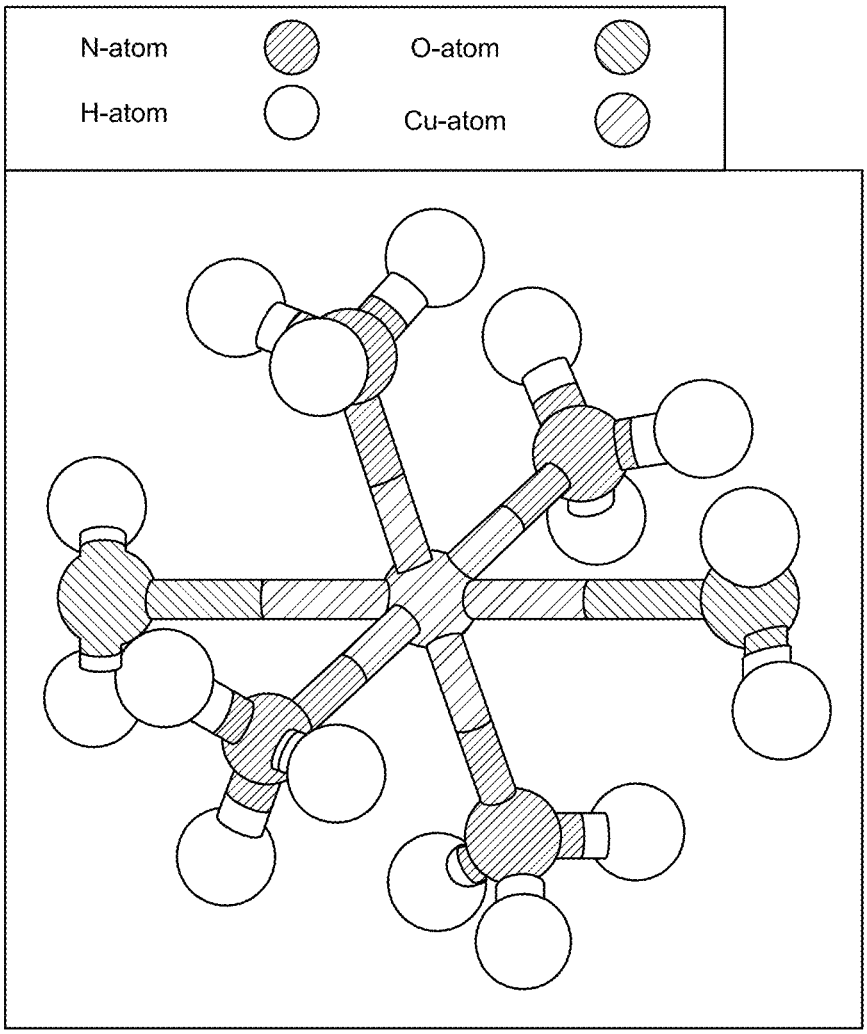
FIG. 6 is a chemical structure of cuoxam solution (tetra-ammine copper hydroxide)

Cuoxam solution was synthesized by treating copper hydroxide with ammonia gas ($NH_3$), under cooling. Since this reaction is exothermic, a large amount of heat is generated during the reaction; therefore the reaction is performed under cooling either by ice or nitrogen liquid, since this reaction is exothermic. FIG. 6 is a chemical structure of the cuoxam solution (tetra-ammine copper hydroxide). The process can be done in a traditional vessel or in a special one modified to be safer for such exothermic reactions.

$$[NH_3+H_2O]+Cu(OH)_2 \rightarrow Cu(NH_3)_4(OH)_2$$

$$NH_3+H_2O \rightarrow NH_4OH$$

One advantage of gaseous ammoniation is continuous maintaining of the ammonia groups ($NH_3^-$) concentration within the liquor all over the reaction duration. With the précised control of the gaseous ammonia-injection process within the copper hydroxide vessel to synthesize the cuoxam solution, the harmful effect of the ammonia smell released from using ammonium hydroxide liquid is eliminated. Also, the process of the present disclosure significantly increased the produced rayon quality and simplified the machinery system applied for rayon production.

The Hardening Bath Using Citric Acid

Figure 7:
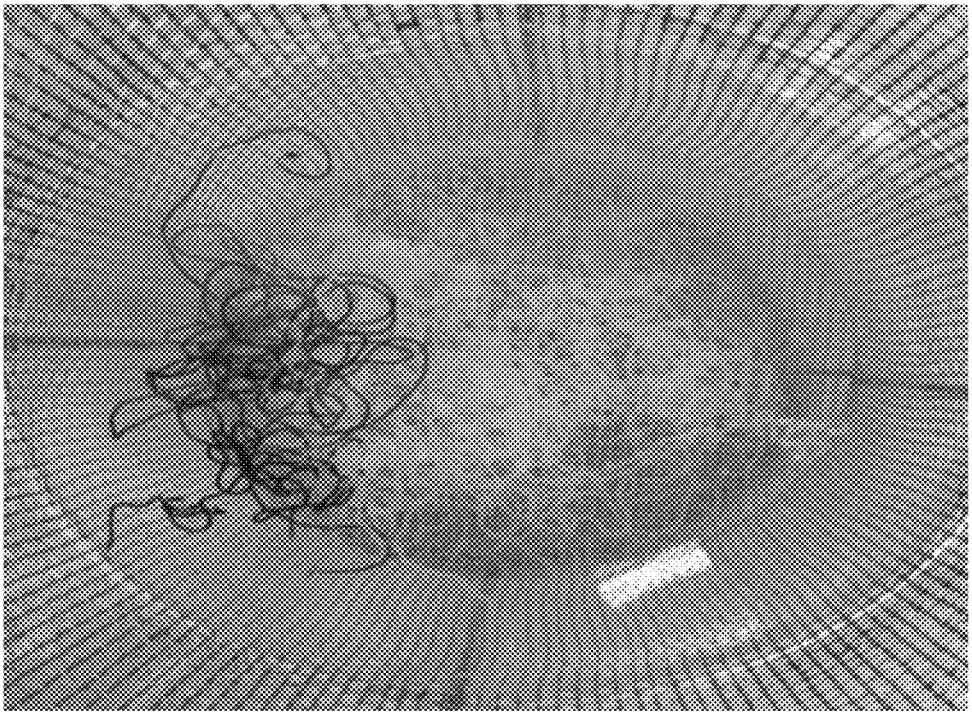
FIG. 7 shows an optical image of rayon fibers hardened/extruded in an acid bath.

The cuoxam solution containing the dissolved cellulose was deposited in a controlled manner using a syringe pump and extruded through its fine nozzle. FIG. 7 shows an optical image of the hardened rayon fibers. The grey threads are pumped ones within the citric acid bath, while the white ones are cured rayon fibers without copper ions. The fibers were regenerated after immersing in the coagulation bath also termed as hardening or curing bath where the cellulose polymer precipitates. The hardening bath contained citric acid (10% wt/wt). The main advantage of this method is that there is no thermal degradation of the cellulosic material. Also, a smaller fiber diameter can be obtained with the process of the present disclosure.

Production of the Rayon fibers

I. The laboratory-Scaled Production

This was done in a one liter-volumetric scale by performing the following steps: a) 50 g of $CuSO_4.5H_2O$ was weighed and dissolved into 1000 g of deionized water. The pH of the solution was adjusted at 3 by adding drops of citric acid (5%), to prevent hydrolysis of the $CuSO_4$. The solution was stirred continuously with a magnetic stirrer until the clearance of the solution was obtained. The solution was further vacuum-filtrated through a fine polypropylene cloth (120 mesh) to obtain a precipitate. The cupric hydroxide precipitate was washed sufficiently with deionized water until the filtrate fails to give a positive test for sulphate ions with barium chloride solution. The neutralized pasty precipitate was further treated with ammonia gas in a beaker. The pasty precipitate then converted to a solution of tetra-ammine cupric hydroxide (cuoxam solution).

About 30 g of well-shredded RWP was converted into cellulosic pulp and was chemically purified using diluted HCl (0.2%, wt/wt), washed until neutralization, and oven-dried to obtain cellulose. Gums, polymers, and inks isolated by a hydromechanical machine, were cast from the surface of the RWP-solution due to their low densities. About 20 g of the cellulose was dissolved in the cuoxam solution with continuous stirring using a magnetic stirrer. This solution was named an uncured-rayon solution. The solution was filtered using a standard sieve (80 mesh) to eliminate undissolved cellulosic particles. After the filtration, the viscosity of the resultant pasty solution was adjusted, based on the desired thickness of the rayon fibers.

The process of the present disclosure uses citric acid ($C_6H_8O_7$) solution (10%, wt/wt) for preparing the hardening bath since it is safer than the ordinary bath of sulphuric acid (10%, wt/wt) concerning the public health considerations. To prepare the 10%-concentration of citric acid in one-liter volume, about 100 g of citric acid was dissolved in about one liter of de-ionized water. Such a hardening bath can be reused multiple times with the frequent adjustment of its pH. The hardening bath was cooled by ice or liquid nitrogen since the curing reaction is exothermic or spontaneous that resulting in excess release of heat energy making the fibers weak and breaking them. In addition, the hardening container had an inner perforated vessel to facilitate exit of the cured rayon fibers from the hardening bath, and for quickly transferring to the subsequent washing step. For pressing the rayon fibers, spinning dope was discharged through the spinneret holes into the coagulation bath containing citric acid (10%, wt/wt) and leading to the formation of relatively thick filaments, that were subsequently stretched to reduce the fineness. For this purpose, an ordinary syringe pump was filled with un-cured rayon solution that was free of any particles of paper, to prevent clogging of the needle of the syringe.

The tip of the syringe was immersed into the solution and was pressed gently to extrude fibers into the bath (Jia et al., 2014). The rayon fibers that were formed in the hardening bath, on contact with the citric acid. The rayon fibers were allowed to stand in the hardening solution for about 15 minutes until decolorizing from blue (represented by gray in the image) to opaque white. As shown in FIG. 6, the recent-pressed threads within the citric acid bath appear in the blue color (denoted by a gray color), which get converted to the white color when lost their copper ions. In certain embodiments, about 5% wt./wt. of glucose was added to the citric acid bath in the ratio of 1:10 to provide the rayon fibers with better superior uniformity.

II. The Prototype-Scaled Production

Scaled up production was performed in a 60 liter-volumetric scale vessel. The process employed for scaled up production is similar to that of laboratory-scaled production except for the following points:

a) a pyrex tank of 60 L-capacity was used for preparation of the free calcium carbonate macerated cellulosic fibers obtained from the RWP as well as for storing and synthesis of copper hydroxide from copper sulphate and sodium hydroxide;

b) stirring solutions were done by using forced-air streams;

c) extrusion of the rayon fibers was done by spinnerets instead of the medical syringe used in the laboratory-scaled case; and d) To prepare the 10%-concentration of citric acid in a 60-liter volume, about 6 kg of citric acid was dissolved in about 60 liters of deionized water.

The Different Rayon Products

Figure 8A:
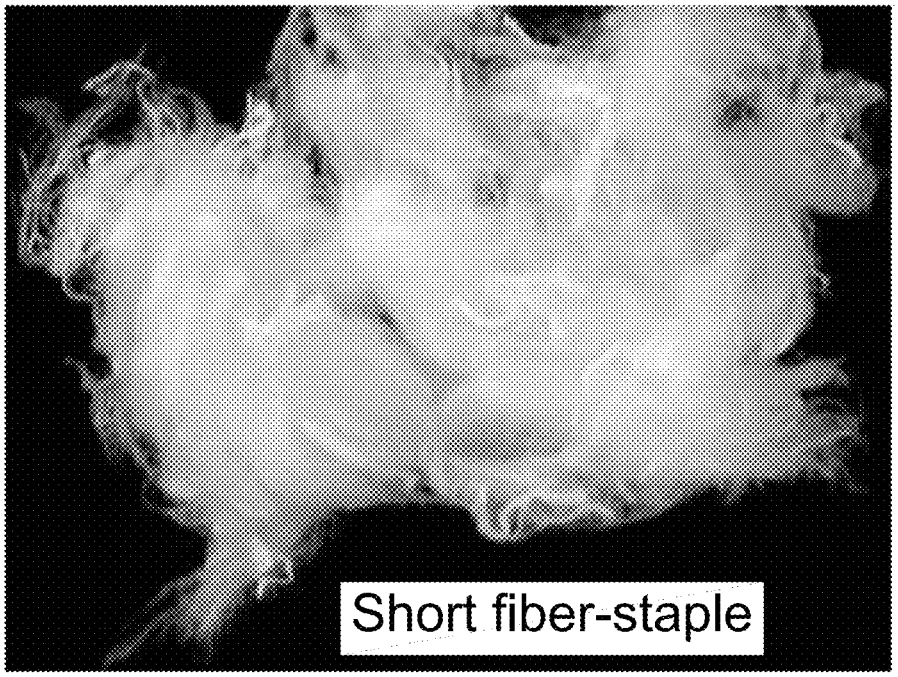
FIG. 8A shows an example of a short fiber-staple made up of rayon fiber.
Figure 8B:
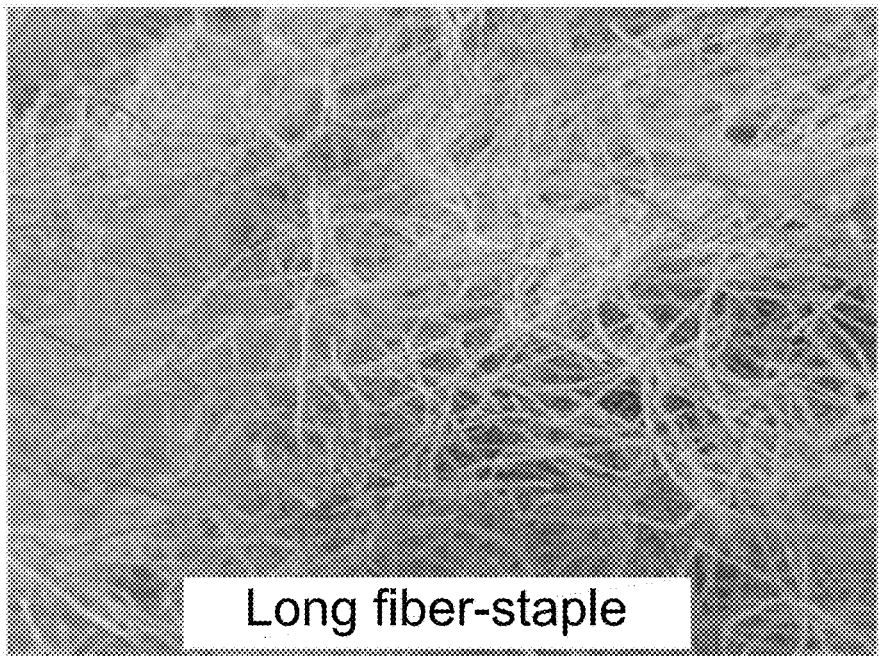
FIG. 8B shows an example of a long fiber-staple made up of rayon fiber.
Figure 8C:
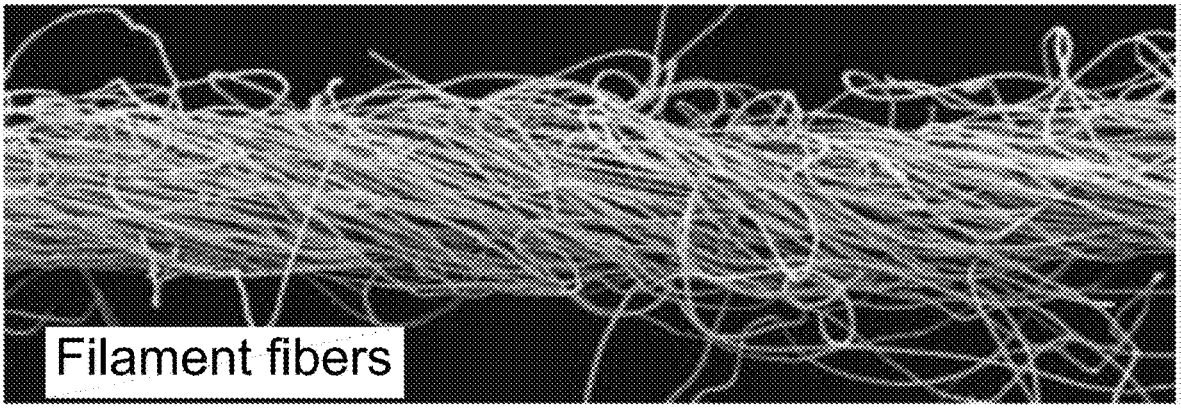
FIG. 8C shows an example of filament fibers made up of rayon fiber.
Figure 8D:
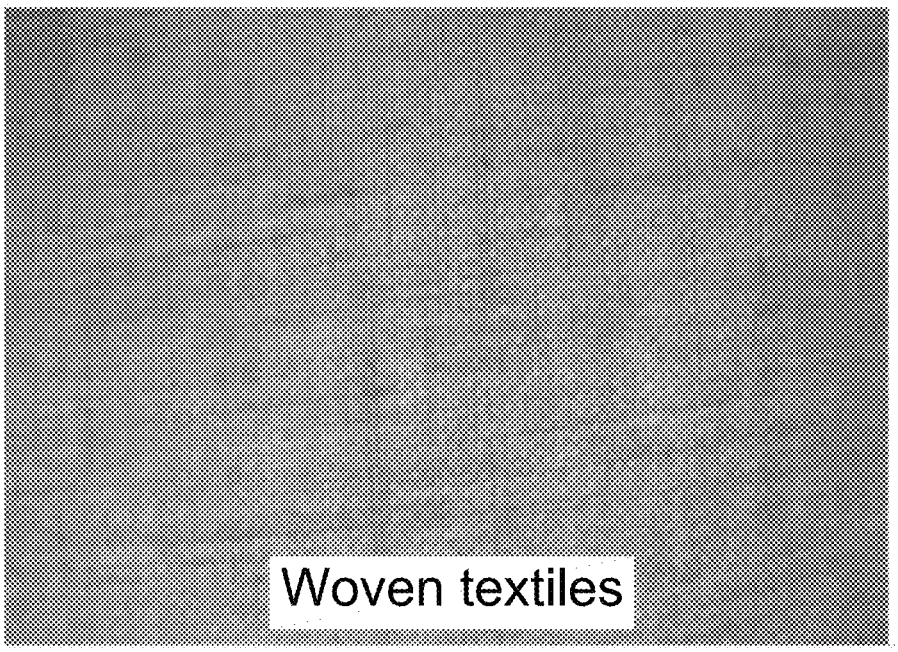
FIG. 8D shows an example of woven textile made up of rayon fiber.
Figure 8E:
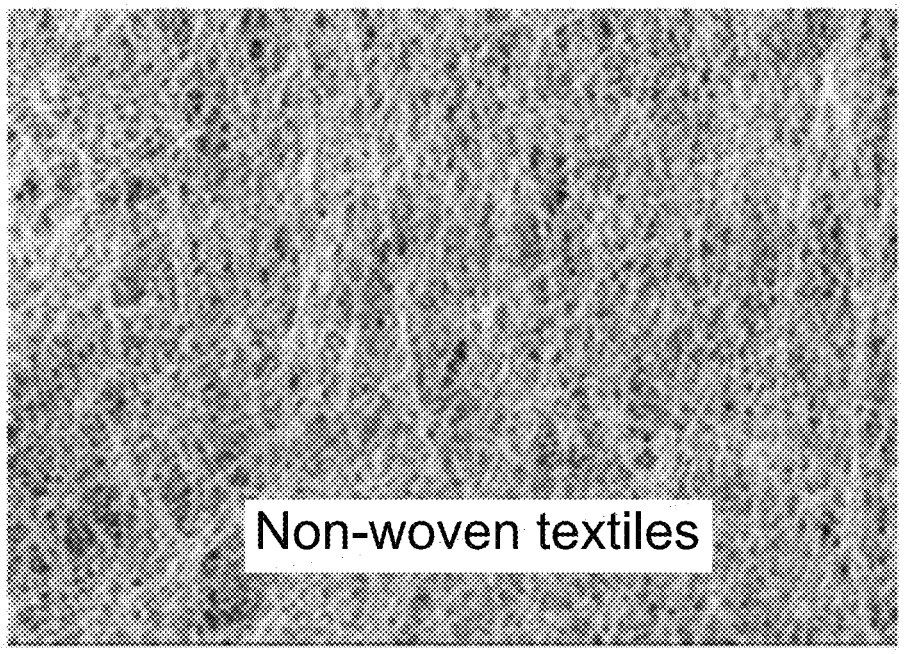
FIG. 8E shows an example of non-woven textile made up of rayon fiber.

Six products of rayon fibers were produced by the process of the present disclosures. FIG. 8A shows an example of a short fiber-staple, a principal product, made up of the rayon fiber. FIG. 8B shows an example of a long fiber-staple made up of the rayon fiber. FIG. 8C shows an example of filament fibers made up of the rayon fiber. FIG. 8D shows an example of woven textile made up of the rayon fiber. FIG. 8E shows an example of non-woven textile made up of the rayon fiber.

Processing the Rayon Fibers

The elementary products of rayon fibers synthesized by the process of the present disclosure were short fiber-staple, long fiber-staple, and filament fibers, while the final products were non-woven and woven textiles. However, to achieve these products, carding, spinning, and weaving processes were applied using primitive tools.

I. The Carding Process

The first step in this industry is the carding process in which the random rayon fibers were ordered and aligned by using a primitive carding machine.

II. The Spinning Process

It is the consequent process after the carding process, whereby staple fibers were converted into threads by using manual twisting beside a manual hand-spindle. The twisting process was performed to enhance the strength of the interfiber cohesion. The rayon yarn's strength and flexibility are extensively reviewed to be dependent on several factors, namely degree of fiber-to-fiber overlap, the surface characteristics of the fibers, the degree of twist, the tightness of the twist, and the fiber strength.

III. The Weaving Process

Weaving was performed by using a primitive weaving machine. The fabric was done, whereby two unique sets of threads were intertwined at right angles to construct a woven fabric. In the weaving process, weft yarns are inserted between two layers of warp yarns at an angle of 90° to the warp yarns. Two weaving structures were constructed in this study, namely, plain weave 1/1 and panama weave 2/2. Accordingly, two different types of textile architecture have been established: a) plain weave 1/1 in which the yarn was crossing over one warp yarn, and b) panama weave 2/2 in which the weft yarns are not crossing every warp yarn. Both architectures were different in their yarn density (the number of yarns related to the width).

IV. The Non-Woven Fabrication Process

Figure 9A:
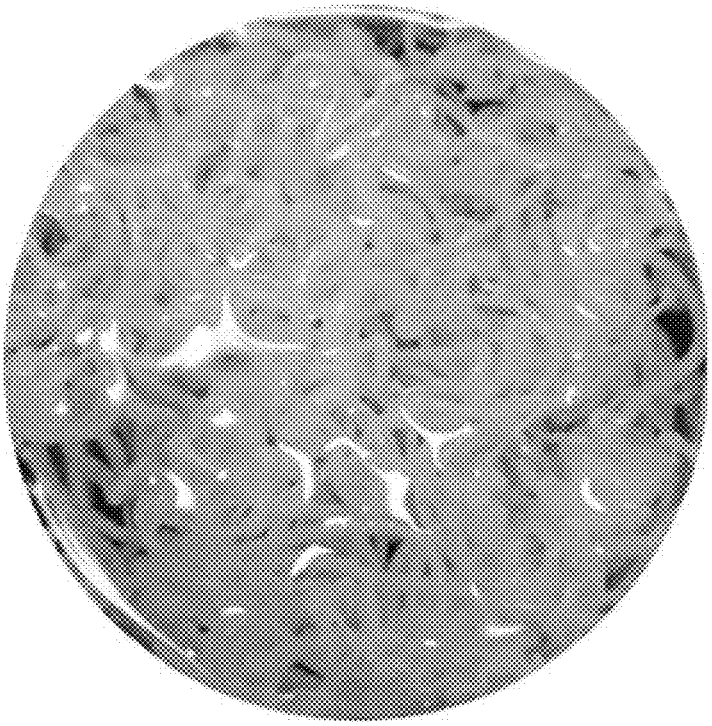
FIG. 9A shows an image of extruded or cured non-woven textile within the hardening bath.
Figure 9B:
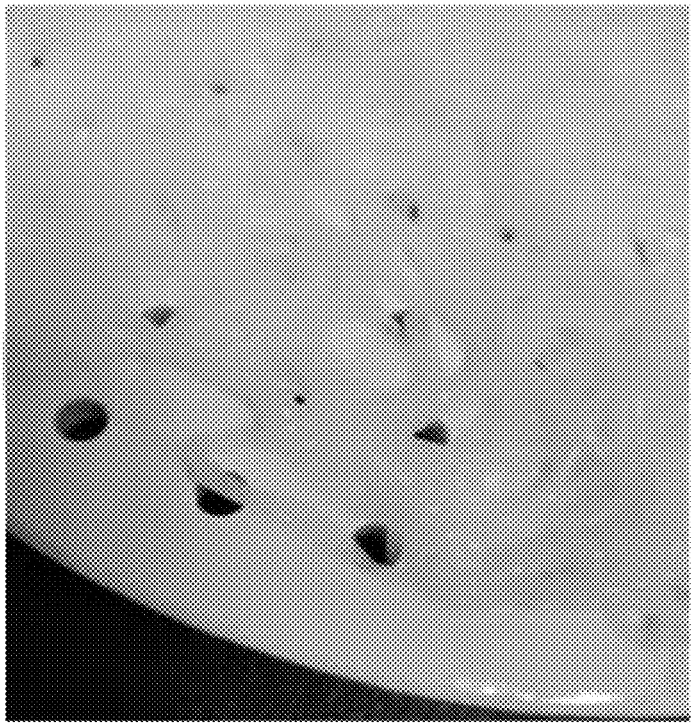
FIG. 9B shows an image of an air-dried non-woven textile after neutralizing and washing.

Nonwoven fabrics are more-or-less random sheets of fibers, which are held together by adhesive bonding, entanglement, or stitching. One-dimensional assemblies are used in cords and ropes. Three-dimensional fabrics are used as composite preforms, either in the form of shaped sheets or thick structures, but also have other applications, such as knitted garments and conveyor belts. FIG. 9A shows an image of the curing of non-woven fabric within the hardening bath. The nonwoven textile was fabricated by extrusion of the rayon fibers within the curing or hardening bath on a perforated plate in a duplicate layer whereby any sub-layer was perpendicular to the other one. FIG. 9B shows an image of an air-dried non-woven fabric after neutralizing and washing. No adhesives were used for binding the fibers into the 3D structure of the non-woven fabric. Accordingly, the binding forces responsible for attracting the cellulosic chains within/between fibers (intra and inter, respectively) were strongly believed to be hydrogen bonding and van der Waals forces. These forces arise between the negative hydroxyl groups ($OH^-$) and $H^+$ belonging to the cellulose macromolecule.

Results

Elimination of Calcium Carbonate from the RWP

Figure 10A:
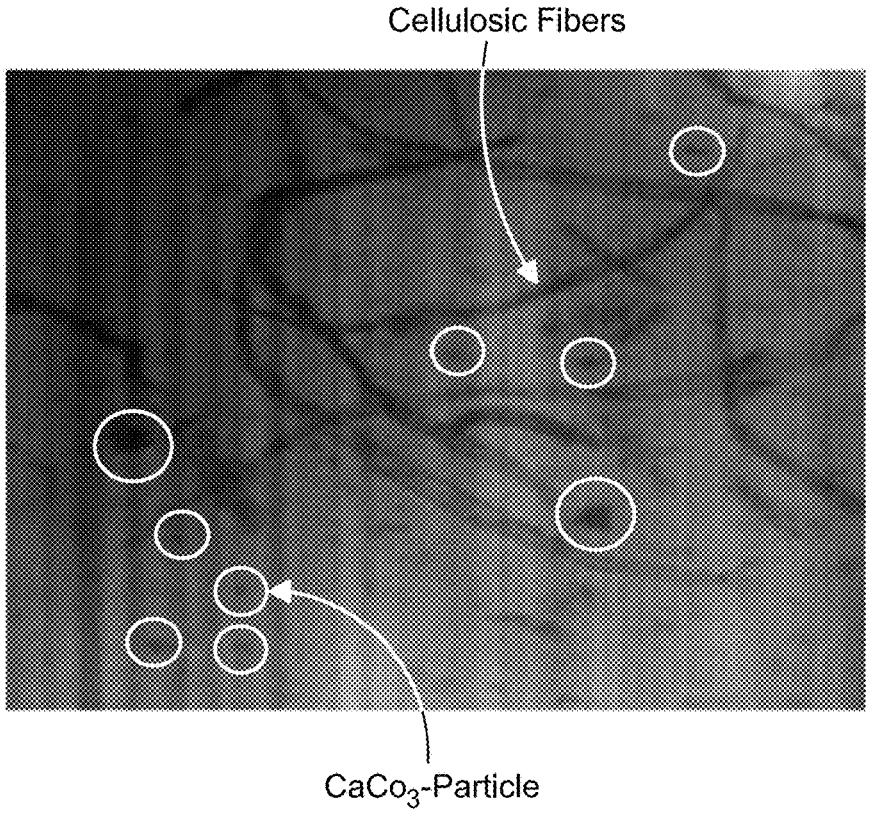
FIG. 10A is an optical image of indicating the dissolved calcium carbonate ($CaCO_3$) particles from the RWP using diluted hydrochloric acid.
Figure 10B:
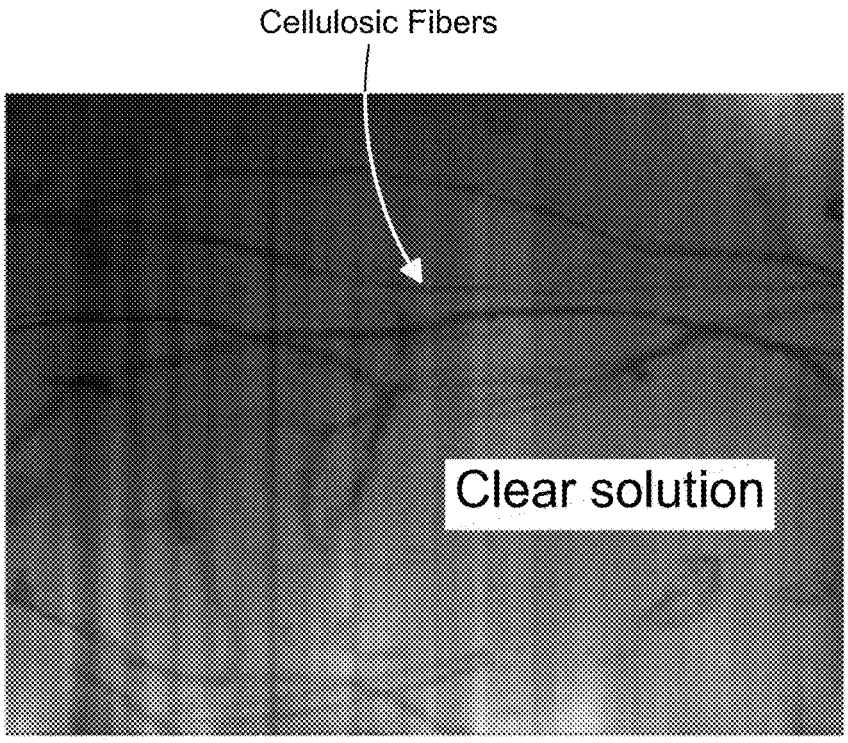
FIG. 10B is an optical image of purified cellulosic fiber in a clear solution.

Monitoring the efficiency of discarding gums, polymers, and inks by hydromechanical treatment as well as eliminating $CaCO_3$ by chemical purification using diluted HCl was studied, and the results are presented in FIGS. 10A and 10B. FIG. 10A is an optical image of the dissolution of calcium carbonate particles from the RWP using diluted hydrochloric acid. FIG. 10B is an optical image of purified cellulosic fiber in a clear solution. The particles of $CaCO_3$ appeared in the FIG. 10A was dissolved in the diluted HCl solution (0.2%, wt/wt) and, consequently, were disappeared as shown in FIG. 10B. It is worth mentioning that the chemical reaction between calcium carbonate and hydrochloric acid took place according to the following equation:

$$CaCO_3+2H^+ \rightarrow Ca_2^+ + H_2O + CO_2 \leftarrow$$

It was noticed that under the reduced pressure, the total acid consumed was reduced while maininting high dissolution. Increasing the dissolution of the $CaCO_3$ with decreasing pressure can be explained by le Chatelier's Law, the stirring effect due to rising bubbles, and the cavitation effect.

Figure 11:
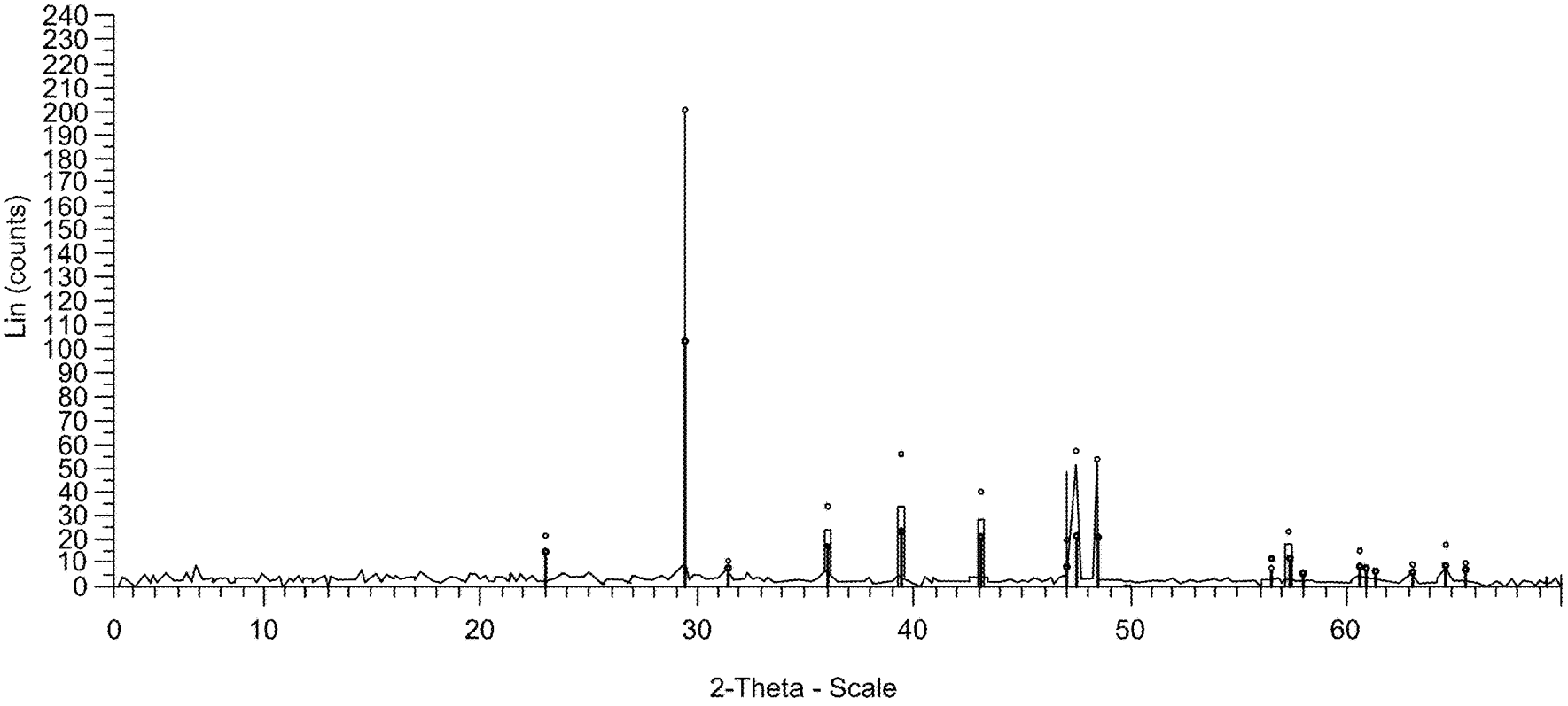
FIG. 11 shows X-Ray Diffraction (XRD) results of pure $CaCO_3$.
Figure 12:
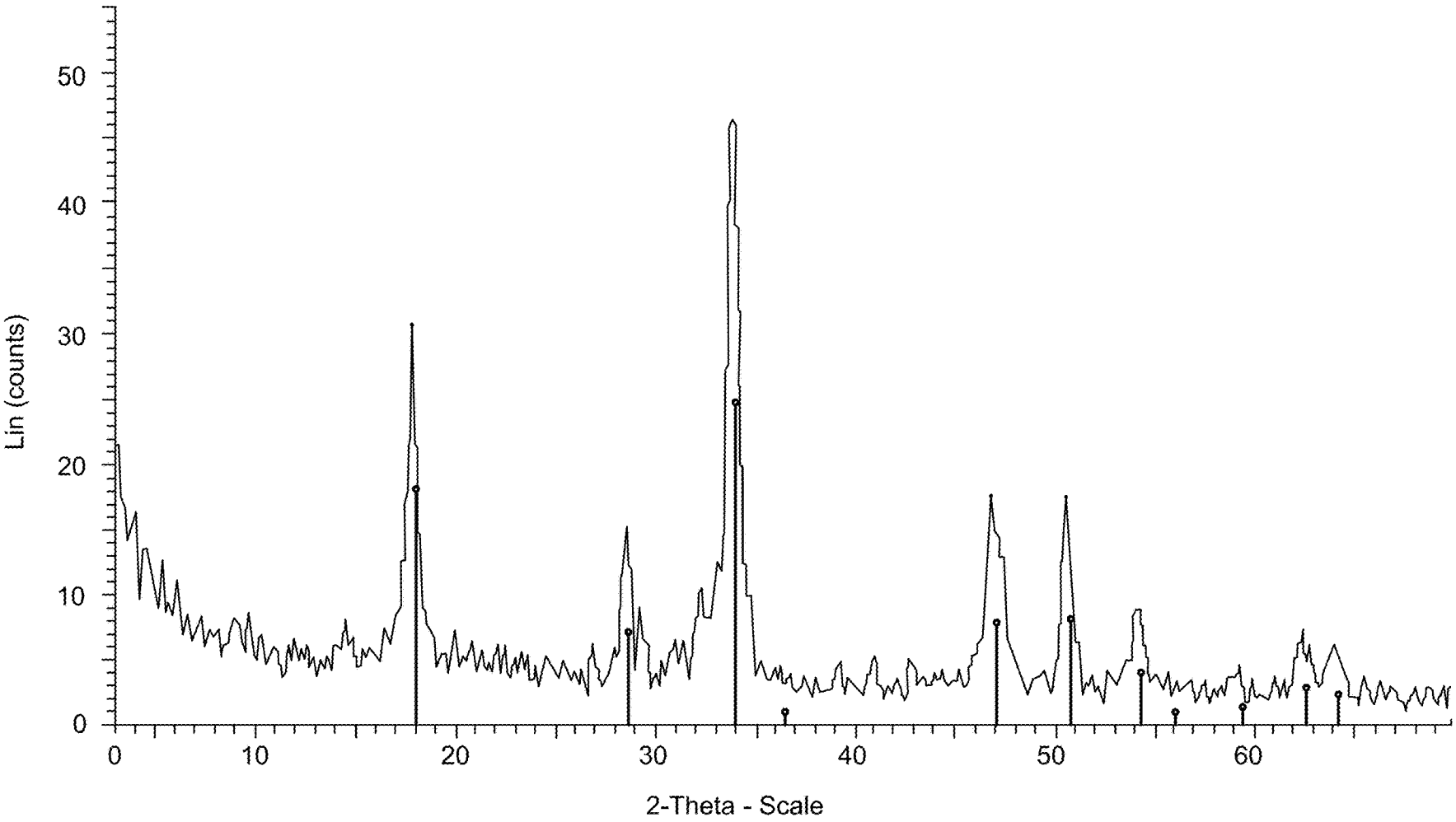
FIG. 12 shows XRD results of crude RWP-pulp.
Figure 13:
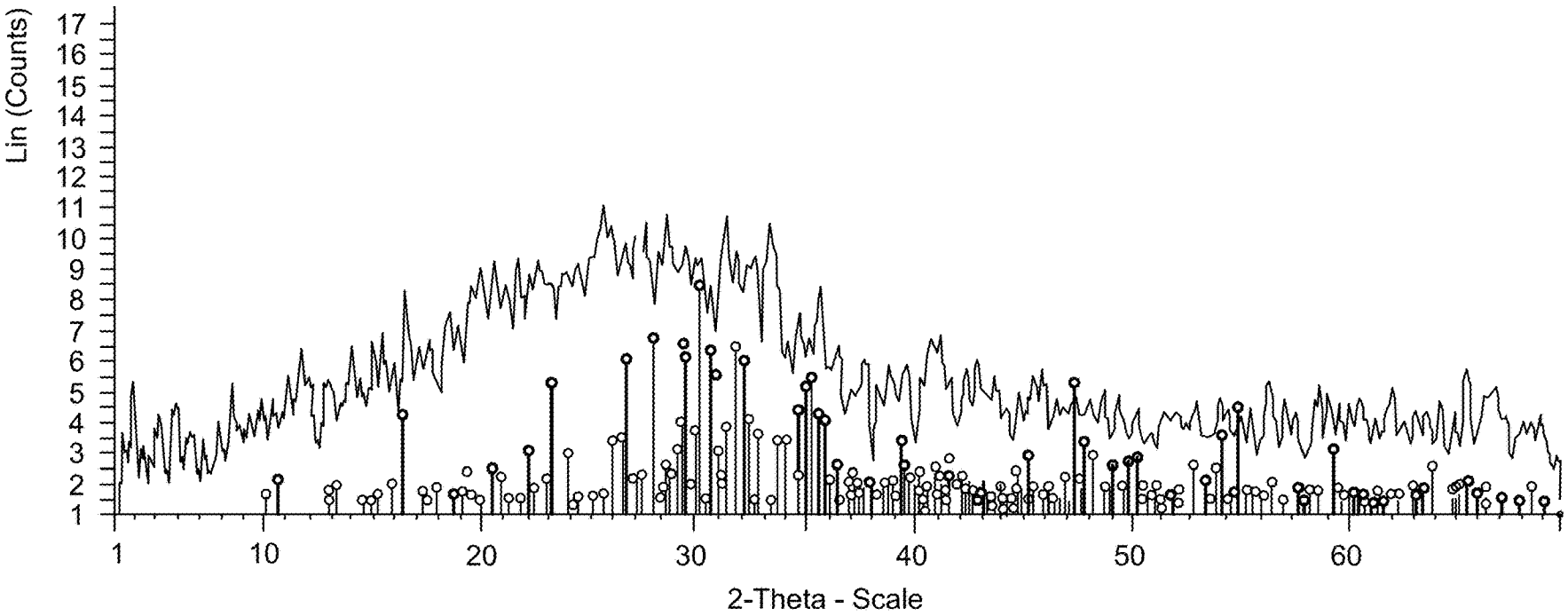
FIG. 13 shows XRD results of purified RWP-pulp.

FIG. 11 shows XRD results of pure $CaCO_3$. Examining the diffractogram of the standard $CaCO_3$, sharp peaks were found to be arisen at about two-theta of the XRD-analysis also revealed that the calcite ($CaCO_3$) constituted about 50.32% of the total standard specimen analyzed. FIG. 12 shows XRD results of crude RWP-pulp. The sharp peaks appeared at 2θ of about 18°, 29° (the principle peaks), 34°, 47°, 51°, 54°, 56°, 59°, 62.5°, and 64° belonged to portlandite termed as calcium hydroxide [$Ca(OH)_2$]. Although the chemical constitution of the compounds detected in both pure $CaCO_3$ and crude RWP-pulp are different, both diffractograms were found to be common in the principle sharp peaks (29°) as well as some minor peaks at 47°, 56°, and 64°. The similar peaks may indicate the common constitution between both compounds. FIG. 13 shows XRD results of purified RWP-pulp. The purified RWP-pulp showed the absence of any sharp peaks related to the $CaCO_3$ and the $Ca(OH)_2$, suggesting that the diluted HCl is an efficient purifier of the RWP from calcium carbonate particles.

The Scientific Illustration of the Rayon Formation

Figure 14A:
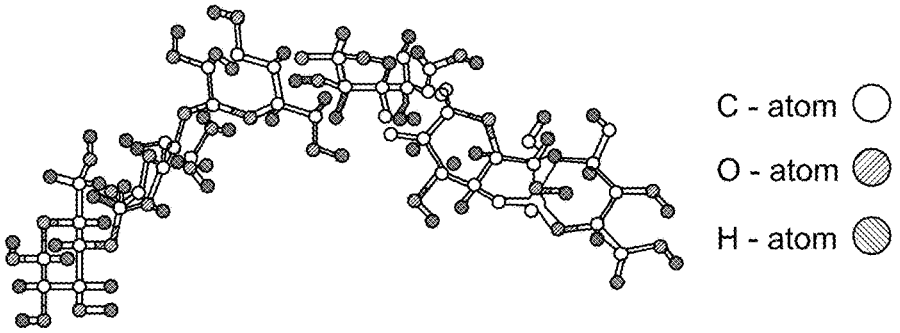
FIG. 14A shows a 3-dimensional atomic structure of a cellulose fiber.
Figure 14B:
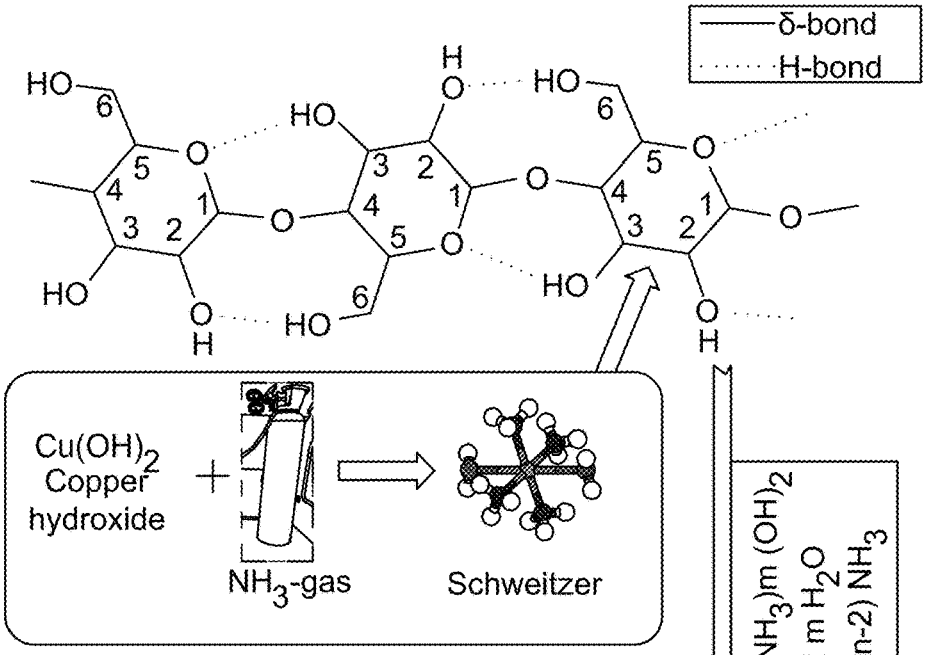
FIG. 14B shows a schematic diagram of hydrogen-bonding within cellulose.
Figure 14C:
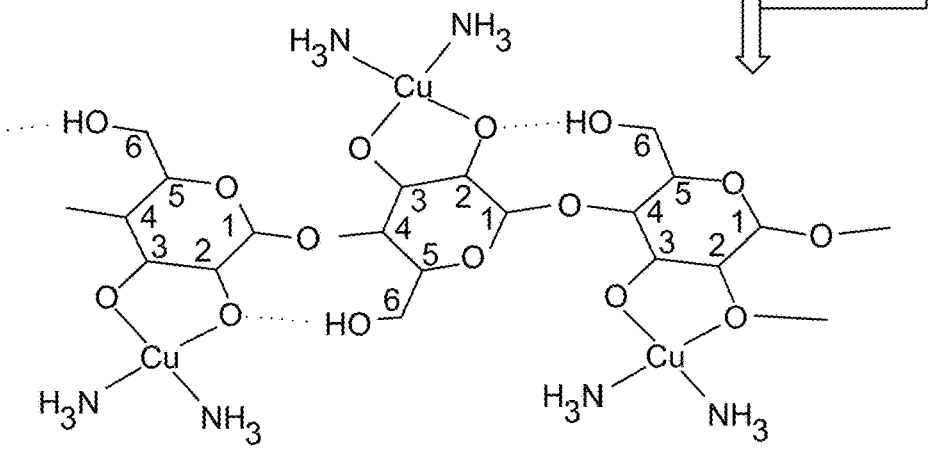
FIG. 14C shows a schematic structure of regenerated cellulose formed after coordinative binding of copper in the cuoxam solution.

The cuoxam solution known as cuoxam's reagent is a metal ammine complex having the formula [$Cu(NH_3)_4(H_2O)_2](OH)_2$]. It is featured by its deep-blue color and is useful to dissolve cellulose. FIG. 14A shows a 3D atomic structure of cellulose fiber and FIG. 14B shows a schematic diagram of hydrogen bonding within cellulose. Cuoxam co-ordinatively binds the deprotonated hydroxyl groups in the C2 and C3 positions of the anhydrous-glucopyranose units (AGU). It can be noticed that the hydrogen bond between the primary OH group in the C6 position and the ring oxygen of the next AGU is interrupted, but the other hydrogen bond is enhanced. These bonds occur on both sides of the chain and cause an enhanced chain stiffness. FIG. 14C shows a schematic structure of regenerated cellulose formed after the coordinative binding of copper in the cuoxam solution. The presence of one primary (C6) and two secondary (C2, C3) hydroxyl groups in an anhydroglucose unit of cellulose predetermines the occurrence of a system of inter- and intrachain hydrogen bonds in the native polymer. This strongly limits the range of one-component solutions suitable for practical use. The IR absorption spectra of cellulose in the OH stretching region (3000-3700 $cm^{-1}$) were analyzed to elucidate the arrangement of intra- and interchain hydrogen bonds. The theoretical estimates confirmed the occurrence of two intra- and one interchain hydrogen bond in the elementary unit of native cellulose. The hydrogen bonding energy in cellulose ranges from 8.5 to 15.0 kJ/mol. Dissolution of cellulose requires breaking of at least all the interchain hydrogen bonds. There are a number of solutions capable of forming hydrogen bonds with the energies Eh above 13.0 kJ mol. It was estimated that the hydrogen bonding energy to be Eh=25.0 kJ/mol, which is about twice that published in the literature for interchain hydrogen bonds in cellulose.

Physical Properties of the Rayon Fibers

The traits studied were the yields of α-cellulose isolated from RWP as well as the physical properties of the rayon synthesized from the α-cellulose, namely melting point, rayon yield, apparent density, moisture content, moisture regain, volumetric shrinkage, and crystallinity index (Table 2).

Table 2. Mean values of the yield of α-cellulose ($Y_C$) and the rayon properties of melting point ($M_P$), rayon yield ($R_Y$), apparent density ($A_D$), moisture content ($M_C$), moisture regain ($M_R$), volumetric shrinkage ($V_S$), and crystallinity index ($C_I$).

TABLE 2

| Property | Data associated with the rayon fibers of the present dislcosure | Standard limits Value | References |
|---|---|---|---|
| $M_P$ (° C.) | 181 [1.43° | 149 | Shamsuddin et al. (2016) |
| $Y_{AC}$ (%) | 90.3 [0.81] | 84.76 | Hindi and Abohassan (2015) |
| $R_Y$ (%) | 92.25 [1.17] | 72.47-88.27 | Zaman and Begum (2020) |
| $A_D$ (g · cm−3) | 1.54 [0.16] | 1.53 | Shishir (2014) |
| $M_C$ (%) | 8.6 [0.98] | 11<br>10.2-12.75 | Abdul Basit et al. (2018) Zaman and Begum (2020) |
| $M_R$ (%) | 7.8 [0.76] | 12.5<br>10.57-12.66<br>14 | Iqbal & Ahmad (2011) Zaman and Begum (2020) Gupta (2013) |
| $V_S$ (%) | 1.8 [0.24] | 1.5 | Nawaz et al. (2002) |
| $C_I$ (%) | 52.6 [1.31] | 50<br>42.2-58 | Miyake et al. (2000)<br>Aytac et al. (2010) |

* Each value is an average of 5 specimens.
* Values within parentheses are standard deviations Melting Point ($M_P$)

The $M_P$ of the rayon fibers was found to be about 181° C. that is in accordance with that for the standard value (above 150° C.). In addition, the $M_P$ average was greater than that measured by Shamsuddin et al. (2016) as shown in Table 2. Accordingly, the melting point of the rayon fibers of the present disclosure is satisfactory, since higher $M_P$ is indicative of the thermal resistance of the fibers. The higher $M_P$ of the rayon fibers suggests a greater thermal stability of the rayon fabrics.

The Yield of Cellulose ($Y_{AC}$)

The average of the $Y_{AC}$ obtained from the RWP after the elimination of impurities such as calcium carbonate, gums, and inks was found to be about 90.3%. This productivity was higher than that found previously by Hindi and Abohassan (2015) as clear in Table 2. This result reflects the efficiency of the hydromechanical method along with the $CaCO_3$-elimination reagent in isolating the cellulose from the RWP.

The Rayon Yield ($R_Y$)

The mean value of $R_Y$ produced from the isolated cellulose was about 92.25%. This output was found to be higher than the $R_Y$ range (72.47-88.27%) obtained by other researchers such as Zaman and Begum (2020) as clear in Table 2. Accordingly, it can be said that the higher the $R_Y$, the more profit can be gained.

The Apparent Density ($A_D$)

The $A_D$ of the rayon fibers was found to be about 1.54 g/cm$^3$. Comparing it with that reported by Shishir (2014), it was observed that the $A_D$ lies within the standard limits as obvious from Table 2.

The Moisture Content ($M_C$)

As indicated from Table 2, the average of the $M_C$ of the rayon fibers was found to be 8.6%. This was lower than the $M_C$ range (10-12.75%) determined by Abdul Basit et al. (2018) and Zaman and Begum (2020).

The Moisture Regain ($M_R$)

The $M_R$ values of cotton and regenerated cellulose are about 7.8% (Table 2). Due to its cellulosic nature, viscose has more amorphous regions giving more voids in its structure (Abu-Rous et al., 2006). This nano-structure of the rayon fibers has some moisture management properties among all viscose blends. It was found to have moisture absorption ability but it wicks less as compared to natural fibers such as cotton fibers (Abu-Rous et al., 2006; Abdul Basit et al. 2018).

Volumetric shrinkage ($V_S$)

The mean value $V_S$ of the rayon fibers was determined to be about 1.8% that lies within the accepted region. This value is higher to some extent than that found by Nawaz et al. (2002) as presented in Table 2. Since the $V_S$ is the dimensional change resulting in a decrease in the length or width of a rayon fiber specimen due to losing some of its moisture content, their fabrics' dimensions are expected to decrease slightly when exposed to heat or evaporation conditions. However, the $V_S$ if the rayon fibers of the present disclosure was small enough to be undistorted for the final product fabrics of the rayon fibers. Since rayon fibers are composed mainly of cellulose that is well known to be hydrophilic in its nature, it can allow the water to soak into the fiber and swell as well as lose moisture and is shrunk. On the other hand, hydrophobic fibers such as cellulose triacetate will exhibit very little shrinkage (Kohler, 2012).

Crystallinity Index ($C_I$) from X-Ray Diffraction (XRD)

Figure 15:
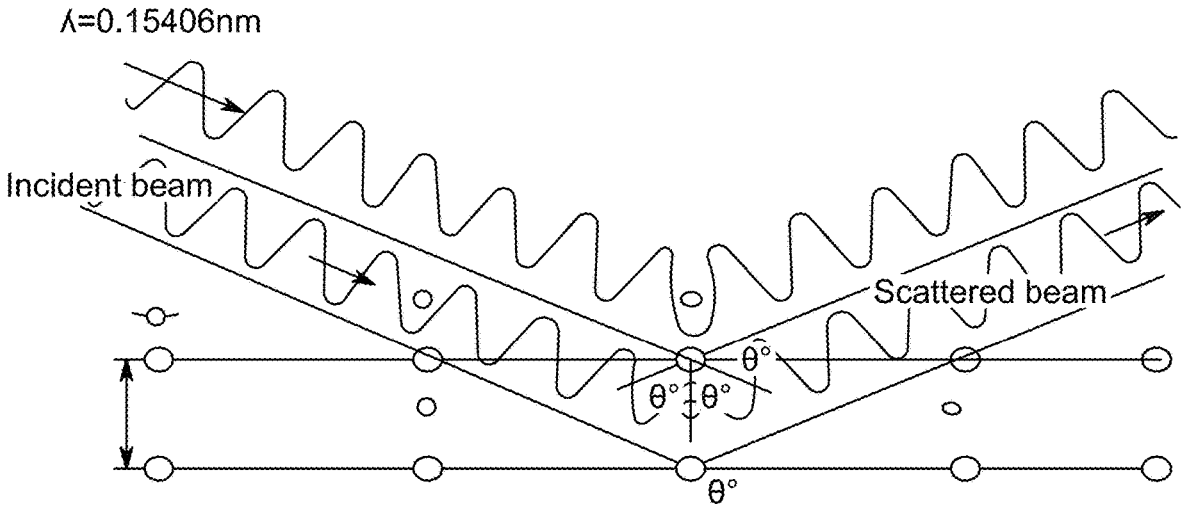
FIG. 15 shows a schematic diagram of Bragg's reflection from lattice planes for the rayon fibers.

FIG. 15 shows a schematic diagram of Bragg's reflection from lattice planes for the rayon fibers. $C_I$ was found to be low (55.6%) suggesting that the amorphous part was removed during acid-hydrolysis.

Figure 16A:
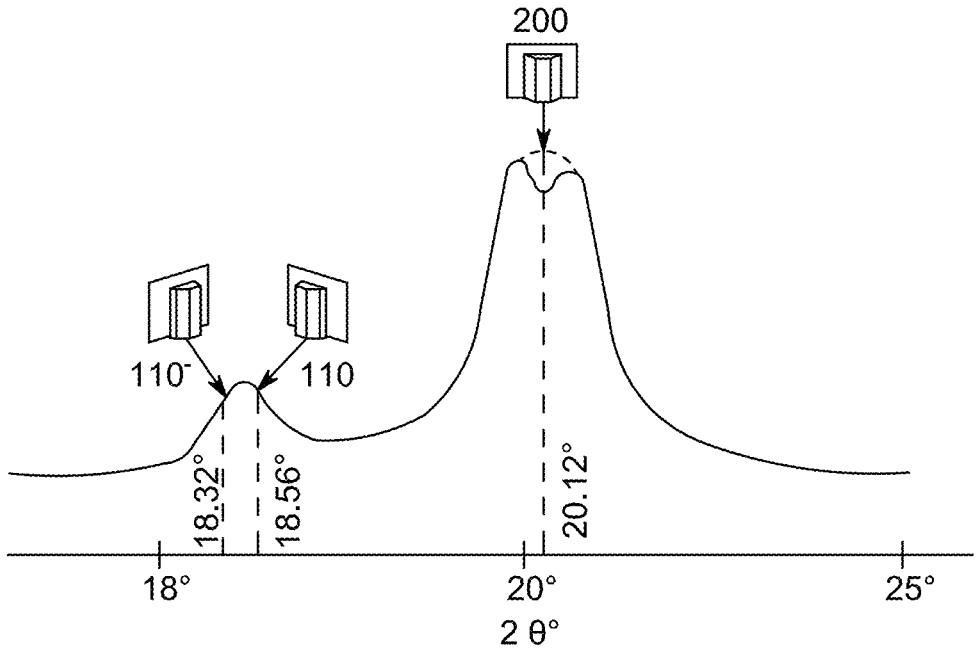
FIG. 16A shows X-Ray Diffraction (XRD) results of rayon fibers.
Figure 16B:
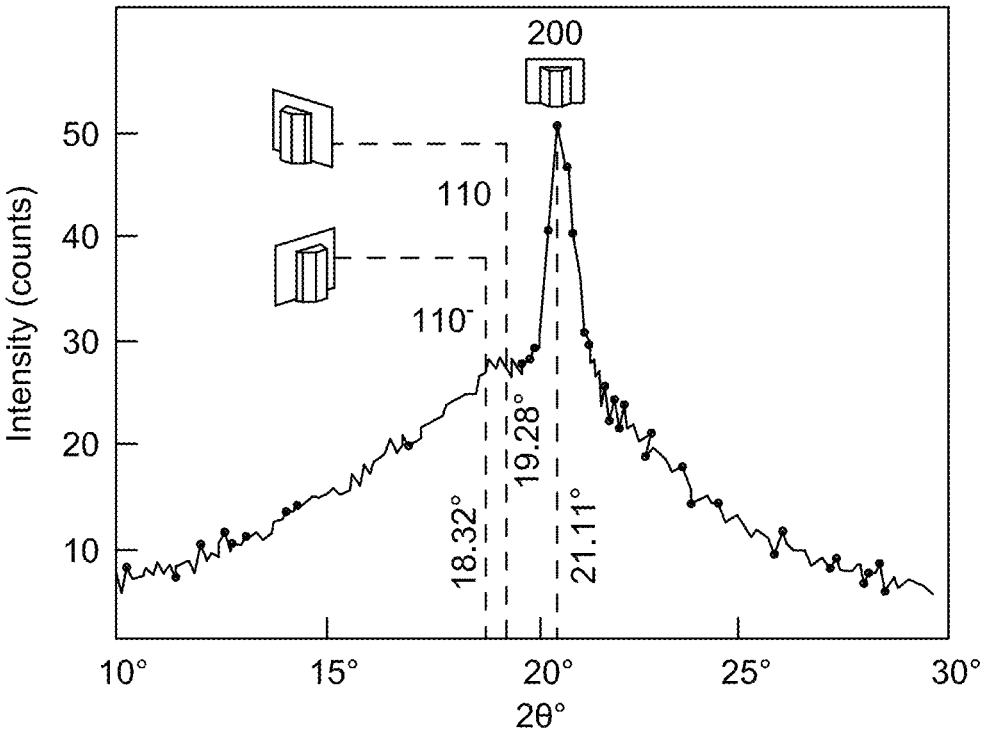
FIG. 16B shows X-Ray Diffraction (XRD) results of alpha cellulose.

FIG. 16A shows X-Ray Diffraction (XRD) results of rayon fibers; and FIG. 16B shows X-Ray Diffraction (XRD) results of alpha cellulose. From these figures, it can be observed that the rayon fibers specimen exhibited a principle sharp peak around 2θ=20.12° that corresponded to the crystallographic of 200. Furthermore, two minor peaks were clear around 2θ of 18.32° and 18.56° corresponding to the characteristic assignments of 110⁻ and 110, respectively. These three peaks correspond to hemicellulose and cellulose.

Chemical Characterization of the Cuoxam Solution Saturated with Cellulose

Two chemical properties of the Cuoxam solution saturated with cellulose, namely molecular weight, and degree of polymerization were analyzed, as shown in Table 3.

TABLE 3

| Property | Data associated with the rayon fibers of the present dislcosure | Standard limits Value | References |
|---|---|---|---|
| $M_W$ (g/mol) | 64,800 [471] | 90,000-110,000 | Shishir, 2014 |
| $D_P$ (Dalton) | 400 [4.9] | 290-430 2<br>85-603.4<br>300-450 | Schwarz and Wannow (1941)<br>Schwarz and Wannow (1941)<br>Iqbal and Ahmad (2011) |

* Each value is an average of 5 specimens.
* Values within parentheses are standard deviations The Molecular Weight ($M_W$)

The $M_W$ of the cuoxam solution saturated with cellulose is presented in Table 3. The molecular weight of viscose is in the range of 90,000 to 110,000 KDa.

The Degree of Polymerization ($D_P$)

The $D_P$ average of viscose polymer is in the range of 300-450 g/mol, as shown in Table 3. Since pulp fibers in their natural state are too short to be spun into yarns, they are dissolved and regenerated in filament form. The rayon fibers are made by the wet spinning principle.

Fibrous Properties of the Cuprammonium Rayon

Five fibrous properties, namely staple length, linear density, and fiber diameter of the rayon were investigated in this study and their mean values are presented in Table 4.

TABLE 4

| Property | Data associated with the rayon fibers of the present dislcosure | Standard limits Value | References |
|---|---|---|---|
| $S_L$, (mm) | 44 [4.8] | 39 | Abdul Basit et al. (2018) |
| $L_D$ (Tex) | 235 [4.31] | 244<br>94-188 | Shamsuddin et al. (2016) Aytac et al. (2010) |
| $F_D$ (μm) | 19.4 [1.49] | 54 | Aytac et al. (2010) |

* Each value is an average of 5 specimens.
* Values within parentheses are standard deviations The Staple Length ($S_L$)

The $S_L$ property was measured and the data were presented in Table 4. The mean $S_L$ value was found to be about 44 mm, which is longer than that produced by Abdul Basit et al. (2018) and lies within the ordinary limit. The average $S_L$ of a group of fibers was reported to be dependent on the origin of the fibers. Increasing the average staple length of the fibers can ultimately make the yarn softer. The rayon fibers can be produced in extremely fine deniers to obtain softness and handle characteristics similar to silk. The burning characteristic of this material was reported to be similar to viscose rayon, whereby it burns rapidly and chars at 181° C.

The Linear Density ($L_D$)

The average $L_D$ was about 235 Tex, which is substantially higher than that range determined by Aytac et al. (2010) and lower than that found by Shamsuddin et al. (2016) as indicated from Table 4. Since the $L_D$ is used as a measure of fineness, it can be said that lower the $L_D$ value, the more fineness for the rayon fibers. The rayon fibers of the present disclosure have lower fineness than those synthesized by Shamsuddin et al. (2016). $L_D$ can be adjusted easily by controlling several parameters, such as diameter of the syringe's nozzles, the viscosity of the cuoxam/cellulose solution, and the pressure of the extruding force. Reducing the diameter of the syringe's nozzles, and reducing the viscosity of the cuoxam/cellulose solution, while increasing the extruding force can help to idealize the rayon fineness.

The Fiber Diameter ($F_D$)

Figure 17:
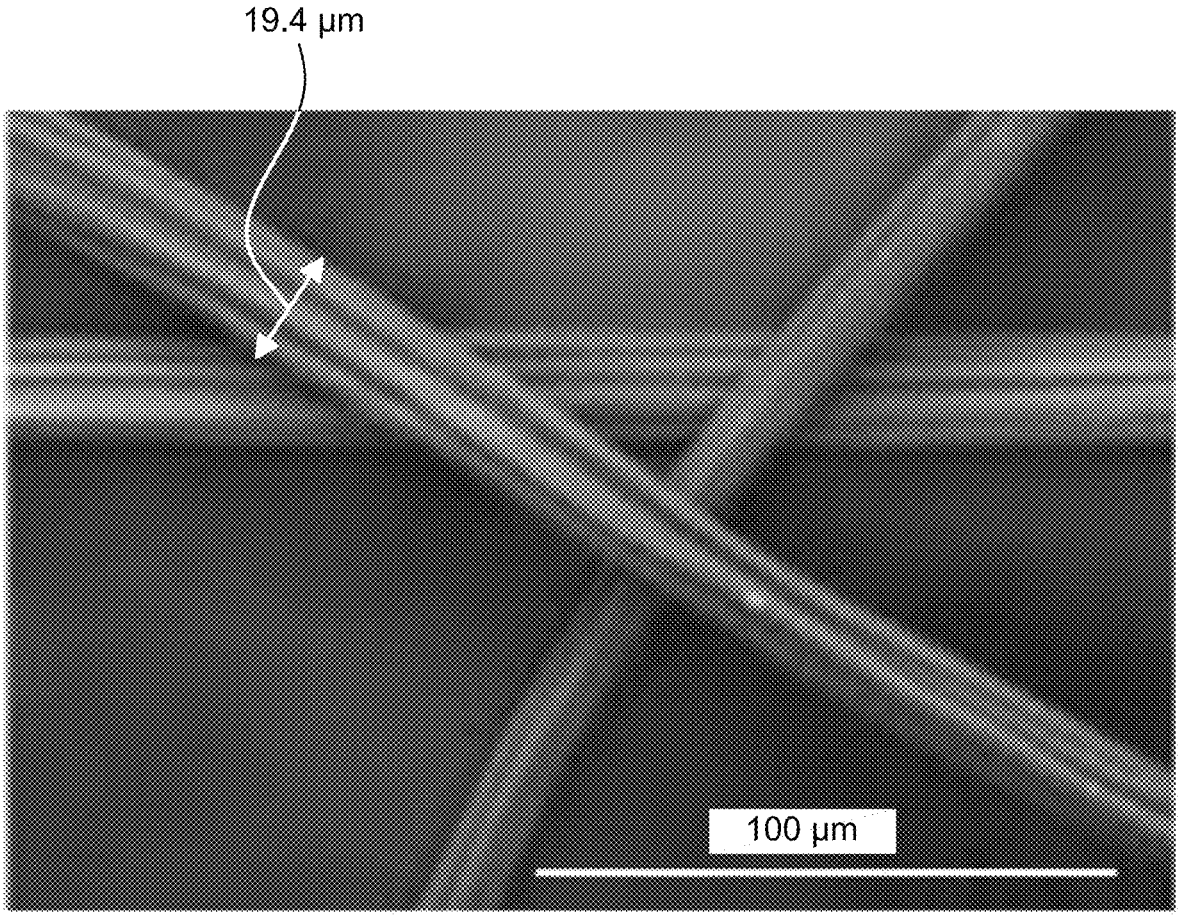
FIG. 17 shows a scanning electron microscopic (SEM) image of the rayon fibers.

The $F_D$ character is an additional indicator for rayon fineness besides the LD. The $F_D$ value was estimated from the SEM image using its scale bar (FIG. 17) and was found to be about 19.4 μm. The obtained average is lower than that found in other studies (54 μm) done by Aytac et al. (2010) as clear from Table 4. FIG. 17 shows a scanning electron microscopic (SEM) image for rayon fiber. It is worth for mention that the original rayon fibers presently being produced have a circular shape of fibers, with wrinkles that can be attributed to the volumetric shrinkage of the rayon fibers upon excessive drying occurred due to the fiber exposure to the high voltage in the specimen chamber of the SEM device. Smaller $F_D$ values allow yarns to be more even, lustrous and stronger.

Mechanical Properties of the Cuprammonium Rayon

Figure 18:
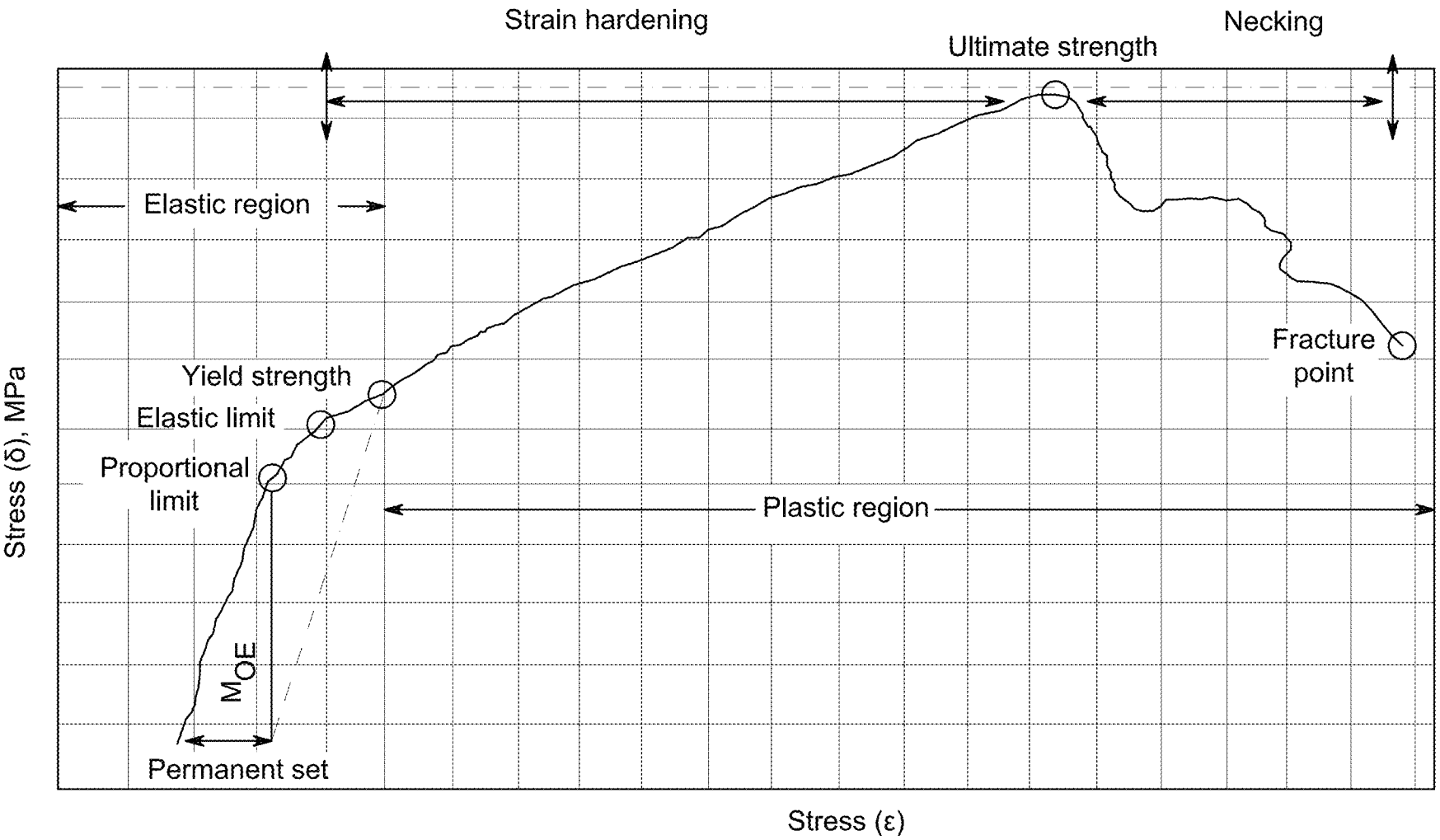
FIG. 18 shows a graph of stress v.s strain for a single filament of the cuprammonium rayon.

Mechanical properties, namely tensile strength, modulus of elasticity termed as Young's modulus, elongation at break, and breaking tenacity are the most important mechanical properties of regenerated cellulose including cuprammonium rayon. FIG. 18 shows a graph of stress v.s strain for a single filament of the cuprammonium rayon. The results were analyzed and presented in Table 5.

TABLE 5

| Property | Data associated with the rayon fibers of the present dislcosure | Standard limits Value | References |
|---|---|---|---|
| $T_S$ (MPa) | 812.3 [4.3] | 154-197 (filament)<br>91-105 (yarn)<br>24.69-30.03<br>222-236 | Miyake et al., 2000<br>Miyake et al., 2000<br>Quazi et al., 2012<br>Shamsuddin et al. (2016) |
| $M_{OE}$ ( GPa) | 14.3 [0.49] | 15<br>15.1-15.6 | Seavey and Glasser (2001)<br>Shamsuddin et al. (2016) |
| $E_B$ (%) | 16.1 [1.09] | 10.6-23.4 (dry)<br>12.7-36.8 (wet)<br>10.6-15.9 (filament)<br>17.6-19.1 (yarn)<br>19.1-32.9 7-14 (dry)<br>20 (wet)<br>20 | Schwarz and Wannow (1941)<br>Schwarz and Wannow (1941)<br>Miyake et al. (2000)<br>Miyake et al. (2000)<br>Aytac et al. (2010)<br>Iqbal & Ahmad (2011) Iqbal & Ahmad (2011)<br>Abdul Basit et al. (2018) |
| $B_T$ (cN/Tex) | 27 | 12.0 ± 3.2-<br>58.0 ± 4.6 (dry)<br>9.2 ± 0.7-<br>40.3 ± 6.4 (wet)<br>4.42-12.38<br>22.08-26.5 (dry) | Schwarz and Wannow (1941)<br>Schwarz and Wannow (1941)<br>Iqbal & Ahmad (2011) Iqbal & |

TABLE 5-continued

| Property | Data associated with the rayon fibers of the present dislcosure | Standard limits | |
|---|---|---|---|
| | | Value | References |
| | | 8.84-22.1 (dry) | Ahmad (2011) |
| | | 12.4-17.7 (wet) | Shaikh et al. (2012) |
| | | 25 | Shaikh et al. (2012) |
| | | | Abdul Basit et al. (2018) |

*Each value is an average of 5 specimens.
*Values within parentheses are standard deviations.

Tensile Strength ($T_S$)

$T_S$ is one of the important properties for describing the mechanical performance of the rayon fibers. A universal testing machine was used to determine the $T_S$ of the test specimen. ASTM D3039 standards (Arumugaprabu et al., 2019). The $T_S$ average value of the rayon is 218.3 MPa as indicated in Table 5. From Table 5 it is clear that there is a wide range of the $T_S$ showed by Miyake et al. (2000), Quazi et al. (2012), and Shamsuddin et al. (2016). The vast range is attributed to the difference in their rayon types tested. However, $T_S$ of the rayon fibers of the present disclosure is close to those found by Shamsuddin et al. (2016) as shown in Table 5. The lower strength of the rayon fibers compared to other regenerated cellulose can be attributed to the lower crystallinity and higher amorphous regions in the rayon structure and vice versa for Tencel material (Kreze and Malej, 2003; Stana-Kleinschek et al., 2003; Carrillo et al., 2004). Changes in tensile strength and elongation with wetting may depend mainly on the number of the molecular chain ends in the amorphous region (Miyake et al., 2000).

Modulus of elasticity ($M_{OE}$)

The $M_{OE}$ is a very important character in handling rayon yarns during such weaving and stentering when sudden tensions are applied (Miyake et al., 2000). The M $M_{OE}$ of the rayon fibers was determined to be 14.3 GPa (as can be observed in Table 5). This average is close to the estimated range of rayon material (15-15.6 GPa) found by Seavey and Glasser (2001) and Shamsuddin et al. (2016).

Elongation at break ($E_B$)

The mean average of $E_B$ estimated for the rayon fibers was found to be 16.1% (as can be observed in Table 5) which is a median of the global range. Ordinary viscose rayon has 10.6-36.8% $E_B$ at the break as determined previously by Schwarz and Wannow (1941), Miyake et al. (2000), Aytac et al. (2010), Iqbal & Ahmad (2011), and Abdul Basit et al. (2018) Changes in tensile strength and elongation with wetting may depend mainly on the number of the molecular chain ends in the amorphous region (Miyake et al., 2000).

Breaking Tenacity ($B_T$)

The $B_T$ of the resulted rayon fibers had a high mean value as compared to that referred by Miyake et al. (2000). The $B_T$ average of the rayon fibers of the present disclosure lies within the determined range (4.42-58 cN/Tex) found in the literature (Schwarz and Winnow, 1941; Iqbal and Ahmad, 2011; Shaikh et al., 2012; Abdul Basit et al., 2018) as can be observed in Table 5.

INDUSTRIAL APPLICABILITY

The rayon fiber prepared by the process of the present disclosure offers several advantages over conventional methods. One advantage of the embodiments according to the present disclosure is the use of gaseous ammonia to react with the copper hydroxide to form the cuoxam solution is the faster rate of reaction thereby making the process substantially faster. Another advantage of the rayon fibers obtained by the process of the present disclosure is that it has high yield and better quality. The rayon fibers have shown good tensile strength, elongation at break, modulus of elasticity, and breaking tenacity. The fiber characteristics render them favorable for use in making sustainable semi-synthetic floss for either insulation purposes or spun threads, woven and non-woven textile clothing, surface coating as well as a binder for carbon briquettes for fluid purification. Yet another advantage of the process of the present disclosure is reusing, recycling, and converting cellulose waste material to value added products thereby enhancing the sustainability, biocompatibility; and other environmental benefits.

It is understood that the examples, embodiments, and teachings presented in this application are described merely for illustrative purposes. Any variations or modifications thereof are to be included within the scope of the present application as discussed.

ACKNOWLEDGMENT

The authors extend their appreciation to the Deputyship for Research & Innovation, Ministry of Education in Saudi Arabia for funding this research work through the project number "2021-090" and King Abdulaziz University, DSR, Jeddah, Saudi Arabia.

The invention claimed is:

1. A method of obtaining rayon fibers from a cellulose waste, the method comprising:

extracting alpha-cellulose from the cellulose waste;

reacting gaseous ammonia with an aqueous solution of copper hydroxide to obtain a cuoxam solution;

dissolving the alpha-cellulose in the cuoxam solution to obtain a chemically modified cellulose;

extruding the chemically modified cellulose into an acid bath to obtain a precipitate; and neutralizing the precipitate to obtain the rayon fibers, wherein the method further comprises extracting alpha-cellulose from the cellulose waste by chemical maceration with hydrogen peroxide and citric acid.

2. The method according to claim 1, wherein the cellulose waste is recycled writing paper (RWP), cardboards and wood shavings.

3. The method according to claim 1 further comprising, treating the macerated cellulose waste with mineral acid under reduced pressure to eliminate calcium carbonate.

4. The method according to claim 3, wherein the mineral acid is hydrochloric acid.

5. The method according to claim 1 further comprising, reacting gaseous ammonia with the aqueous solution of copper hydroxide at a temperature range of 5-15° C. under atmospheric pressure.

6. The method according to claim 1 further comprising, preparing the aqueous solution of copper hydroxide by reacting copper sulphate with sodium hydroxide at a temperature range of 25-37° C.

7. The method according to claim 6, wherein a volumetric ratio (v/v) of copper sulphate to sodium hydroxide is in a range of 5:1 to 1:1.

8. The method according to claim 1, wherein the acid bath comprises citric acid.

9. The method according to claim 8, wherein a weight percentage of the citric acid in the acid bath is in a range of 8-15%.

10. The method according to claim 1, wherein the rayon fibers have a staple length in a range of 40-50 millimeters (mm).

11. The method according to claim 1, wherein the rayon fibers have a linear density in a range of 200-250 Tex.

12. The method according to claim 1, wherein the rayon fibers have a fiber diameter in a range of 19-20 micrometer (μm).

13. The method according to claim 1, wherein the rayon fibers have a tensile strength in a range of 218.3-236 Megapascals (Mpa).

14. The method according to claim 1, wherein the rayon fibers have an elongation at break in a range of 16.1%-36%.

15. The method according to claim 1, wherein the rayon fibers have a modulus of elasticity in a range of 14.3-15.6 Gigapascals (GPa).

16. The method according to claim 1, wherein the rayon fibers have a breaking tenacity in a range of 27-58 cN/Tex.

17. The method according to claim 1, further comprising processing the rayon fibers to produce one or more of fiber-staples, filament fibers, woven textiles, non-woven textiles, or any combination thereof.

* * * * *